United States Patent [19]

Rostocil

[11] 4,066,000

[45] Jan. 3, 1978

[54] MACHINE GUN

[75] Inventor: Charles Edward Rostocil, Sugar Grove, Va.

[73] Assignee: Brunswick Corporation, Skokie, Ill.

[21] Appl. No.: 464,109

[22] Filed: Apr. 25, 1974

[51] Int. Cl.[2] ..... F41D 9/02; F41D 11/06; F41D 11/12; F41F 17/10; F41F 17/12

[52] U.S. Cl. ..... 89/198; 42/1 S; 42/25; 42/75 A; 42/75 B; 42/76 R; 42/77; 89/1 K; 89/14 C; 89/33 BC; 89/34; 89/37 B; 89/130; 89/132; 89/134; 89/148; 89/180; 89/199

[58] Field of Search ..... 89/180, 198, 199, 37 GM; 42/76

[56] References Cited

U.S. PATENT DOCUMENTS

| | | | |
|---|---|---|---|
| 1,165,621 | 12/1915 | Nelson | 89/180 |
| 2,421,858 | 6/1947 | Trimbach | 89/37 GM |
| 3,198,076 | 8/1965 | Stoner | 89/198 |
| 3,318,192 | 5/1967 | Miller et al. | 89/199 |
| 3,489,060 | 1/1970 | Marocchi | 89/180 |
| 3,651,736 | 3/1972 | Ingram | 89/199 |
| 3,736,693 | 6/1973 | Koch | 42/76 R |

*Primary Examiner*—Stephen C. Bentley
*Attorney, Agent, or Firm*—John G. Heimovics; Sheldon L. Epstein

[57] ABSTRACT

An automatic weapon incorporating a retarded blow back, a cartridge and bolt centering assembly, light weight and minimum component construction, simplicity in disassembly, easily detachable barrel, unique belted ammunition feed system, disposable ammunition box, a guide buffering assembly, muzzle brake, remote firing capability, front sight charging system and a bulkhead recoil absorbing arrangement.

82 Claims, 57 Drawing Figures

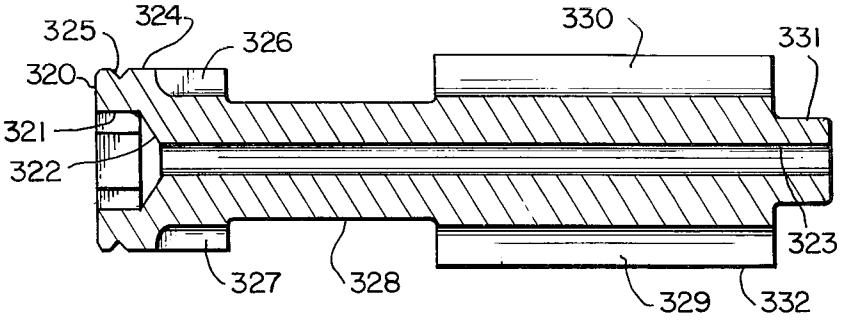
FIG. 22
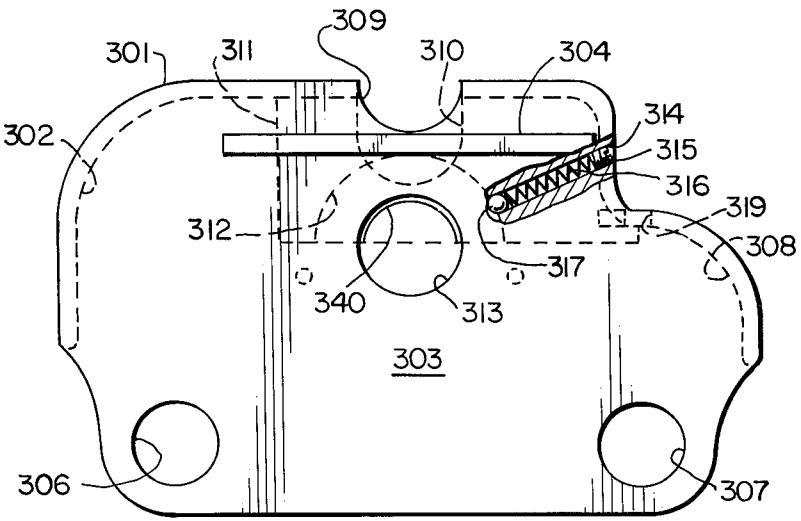
FIG. 21
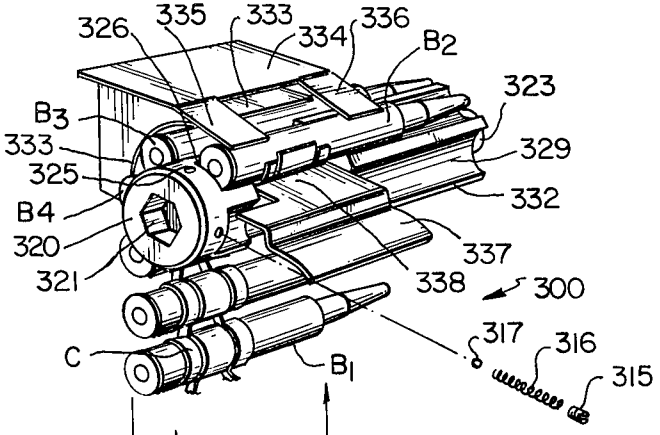
FIG. 20
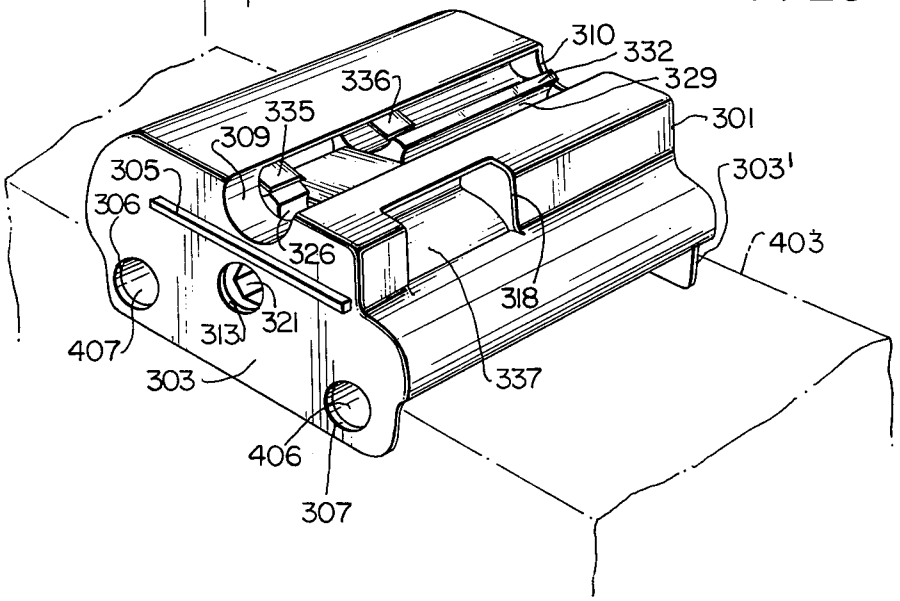

FIG. 54
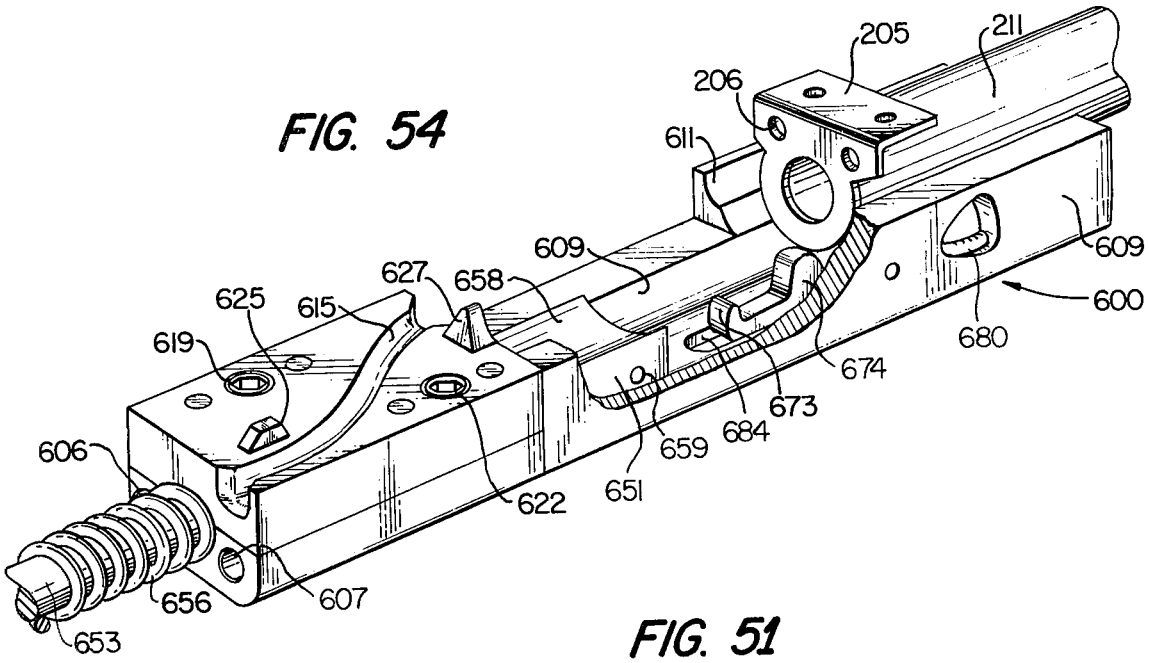
FIG. 51
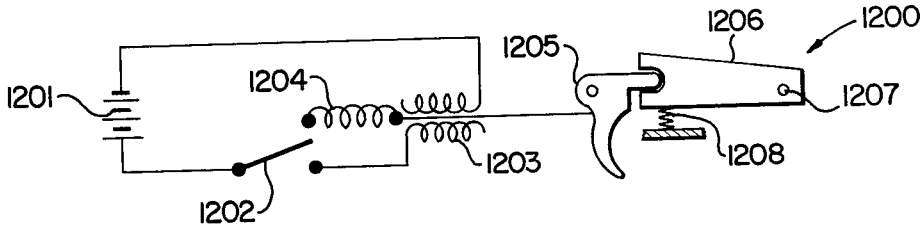
FIG. 52
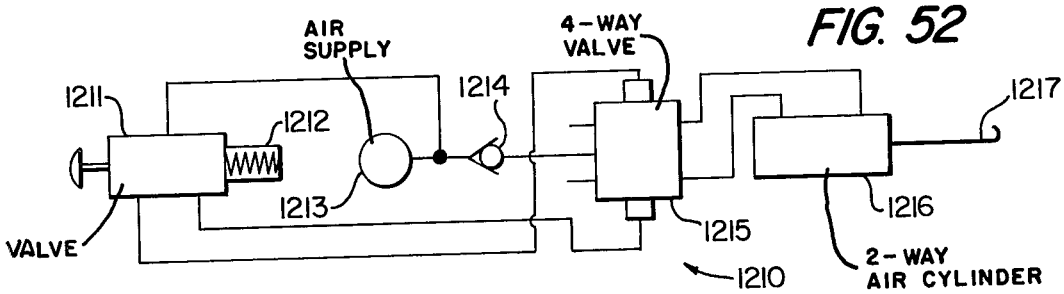
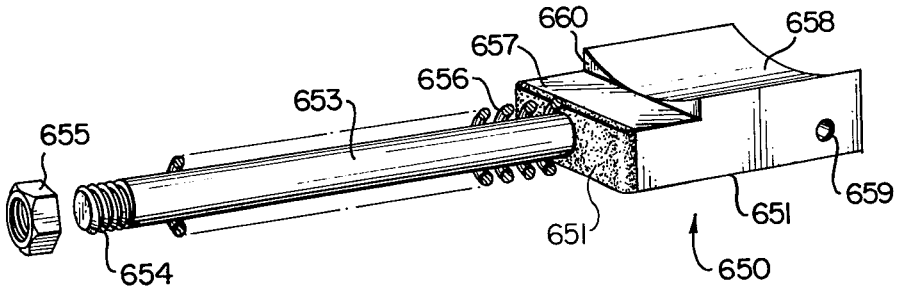
FIG. 48

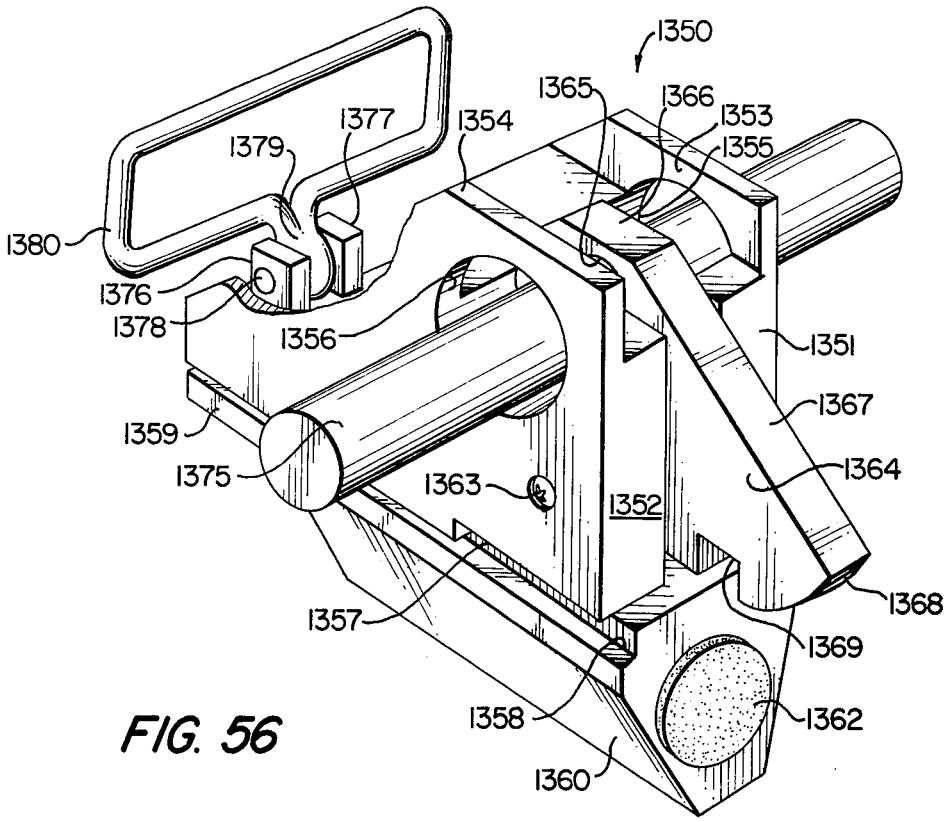
FIG. 56
FIG. 57
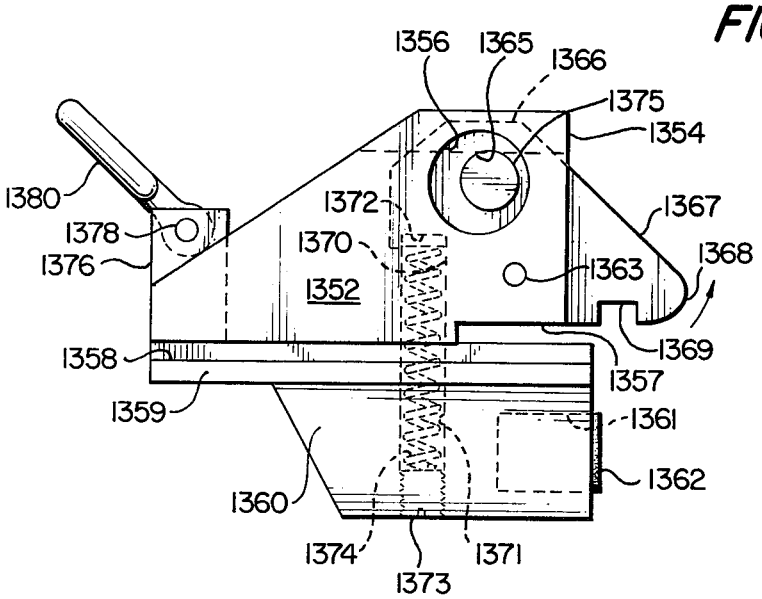

MACHINE GUN

The instant weapon incorporates retarded blow back, belt fed, and is a fully automatic light machine gun. The low weapon weight and the high packing density of its ammunition allows one infantryman to satisfy the light machine gun tactical requirements previously requiring a minimum of two infantrymen. In addition, its light weight and ease of handling permits the tactician to fully utilize new infantrymen mobility found in the helicopter and armored vehicles. The weapon can utilize the new 6MM cartridge that tactically duplicates the present 7.62 NATO cartridge. It can be constructed to fire any caliber ammunition.

The weapon incorporates a retarded blow back action, which uses the cartridge case itself for bolt retardation, and thus permits the basic mechanism to be extremely simple. By minimizing the number of components, basic weapon reliability and serviceability is greatly improved. To complement the retarded blow back mechanism, a unique feed system was developed. The feed system permits ammunition belts of any length to be loaded and unloaded from the weapon with speeds comparable to present box magazine weapons. Because the weapon is capable of high volume sustained fire, the gun barrel was made "quick changeable" by another unique method. The weapon barrel change can be accomplished from any position, including any standard firing position or mount installation, in less than five seconds. To maximize the tactical usefulness of the weapon, a foldable bipod was designed integral with the receiver. The bipod permits accurate, long range firing from the prone position, while not deterring the weapons flexibility when using the offhand or hip firing methods. To assure the safety of the gunner under all conditions, many unique safety features were incorporated into the basic mechanism. No moving exterior components, shrouded bolt, recessed bolt face, vented forward receiver and telescoping bolt, are a few of the integral safety features.

In addition to the tactical and functional qualities incorporated into the mechanism, the production of the final systems was considered from the very first. Although the weapon is a light machine gun, its cost and simplicity of fabrication is similar to that of the present assault rifle. This permits expanded tactical utilization of the weapon system over existing light machine guns.

Accordingly, it is an object of this invention to provide a new and improved fire-support system.

A further object of this invention is to provide a machine gun with a quick change barrel.

A still further object of this invention is to provide an improved machine gun with a minimum of recoil.

Another object of this invention is to provide an improved machine gun utilizing a modified blow-back firing system.

Another object of this invention is to provide a new and improved machine gun in which the ejection part is closed both in the cocked and uncocked position.

Another object of this invention is to provide a standardized construction for an automatic fire weapon that can be made in versions ranging from a small caliber to a very large caliber.

Another object of this invention is to provide an automatic fire weapon that can be fired from a bipod position or from a standard machine gun mount.

Another object of this invention is to provide an automatic fire weapon that has a front sight that is also a charger for charging the weapon.

Another object of this invention is to provide a detachable barrel for an automatic weapon wherein the bottom of the receiver forms a handle grip for removing the barrel.

Another object of this invention is to provide an automatic fire weapon that can fire different caliber projectiles by merely interchanging barrels.

Another object of this invention is to provide an automatic fire weapon having holes in the receiver housing to provide cooling and stress relieving.

Another object of this invention is to provide an automatic weapon which disassembles so as to allow withdrawal of the bolt assembly from the rear of the weapon.

Another object of this invention is to provide an automatic weapon having a bulkhead at the front end of the receiver housing which absorbs most of the recoil of the bolt assembly.

Another object of this invention is to provide an automatic weapon which has a permanent front sight which is not removed during a barrel change.

Another object of this invention is to provide an automatic weapon which has a break-away shotgun type of disassembly.

Another object of this invention is to provide an automatic weapon wherein the bipod is not bulky, forms a handle for firing while in standing position and is not attached to the barrel.

Another object of this invention is to provide an automatic weapon having angular slots in the muzzle which forms part of the recoil system.

Another object of this invention is to provide an automatic weapon which the user can change the barrel while in a prone position.

Another object of this invention is to provide an automatic weapon wherein the barrel may not be changed unless the bipod is in a down position, thus insuring against dirt getting into the receiver.

Another object of this invention is to provide an automatic weapon having a new and improved cartridge feed system.

Another object of this invention is to provide an adapter and disposable magazine for an automatic weapon.

Another object of this invention is to provide a rotary feed system for an automatic weapon which can be used individually with a cartridge belt or with a magazine.

Another object of this invention is to provide a disposable plastic magazine which may be provided singularly or with a rotary feed adapter thereon as a unit.

Another object of this invention is to provide an automatic weapon having a disposable magazine with a transparent portion by which the gunner can ascertain how much ammunition remains therein.

Another object of this invention is to provide a unique ammunition feed system for an automatic weapon without the use of springs to feed the ammunition.

Another object of this invention is to provide a magazine for an automatic weapon wherein the magazine has pivotable handles that are used as carrying handles for the automatic weapon.

Another object of this invention is to provide a detachable feed system with a rotary feed cam for an automatic weapon.

Another object of this invention is to provide a rotary feed advance cam system for an automatic weapon wherein automatic firing of the gun advances the cam.

Another object of this invention is to provide a detachable ammunition feed system for an automatic weapon that can accommodate different size rounds.

Another object of this invention is to provide a latching forward sight charger on an automatic weapon.

Another object of this invention is to provide a remote firing automatic weapon.

Another object of this invention is to provide a cartridge centering bolt assembly in a fully automatic weapon.

Another object of this invention is to provide a bolt assembly for an automatic weapon which allows for two rates of fire.

Another object of this invention is to provide a unique barrel locking system.

Another object of this invention is to provide a magazine for an automatic weapon that is sealed and has a rotary feed advance system incorporated therein.

Another object of this invention is to provide a magazine that also acts as a support for an automatic weapon.

Another object of this invention is to provide a unique recoil buffering system for an automatic weapon.

Another object of this invention is to provide an automatic weapon that can be quickly field stripped into five major components or fourteen minor components.

Another object of this invention is to provide an automatic machine gun that is over powered.

Another object of this invention is to provide an automatic machine gun construction wherein the rate of fire can be varied by changing the weight of the bolt.

Another object of this invention is to provide a unique recoil system for an automatic weapon which will cock with or without the barrel in place.

Another object of this invention is to provide an automatic weapon using a blow-back firing system without any holding paws.

These and other objects of this invention will become apparent when reference is had to the accompanying specification and drawings in which:

FIGS. 4–7 can be laid end to end to show a complete side sectional view of the machine gun;

FIG. 20 is an exploded perspective view showing the feed advance adapter and the components thereof in exploded position;

FIG. 21 is a rear view of the feed advance adapter;

FIG. 22 is a sectional side view of the rotary feed advance cam;

FIG. 48 is a perspective view of the chambering pad and buffering spring guide;

FIG. 51 is a schematic of an electrical firing system;

FIG. 52 is a schematic of a remote control firing system;

FIG. 54 is a perspective view, partially broken away of the buffer guide and sear mounted in the bolt assembly;

FIG. 56 is a perspective view of an alternative charging sight.

FIG. 57 is a side view of the charging side of FIG. 56.

Figure 1:
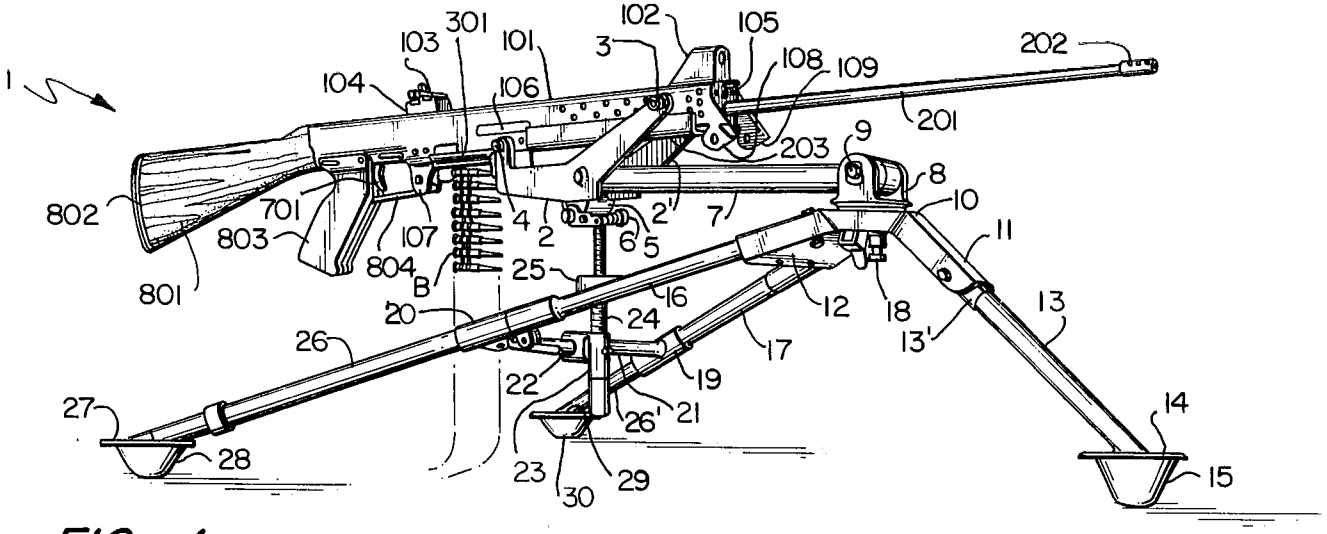
FIG. 1 is a perspective view of the machine gun on a standard field mount showing a belt feed.
Figure 2:
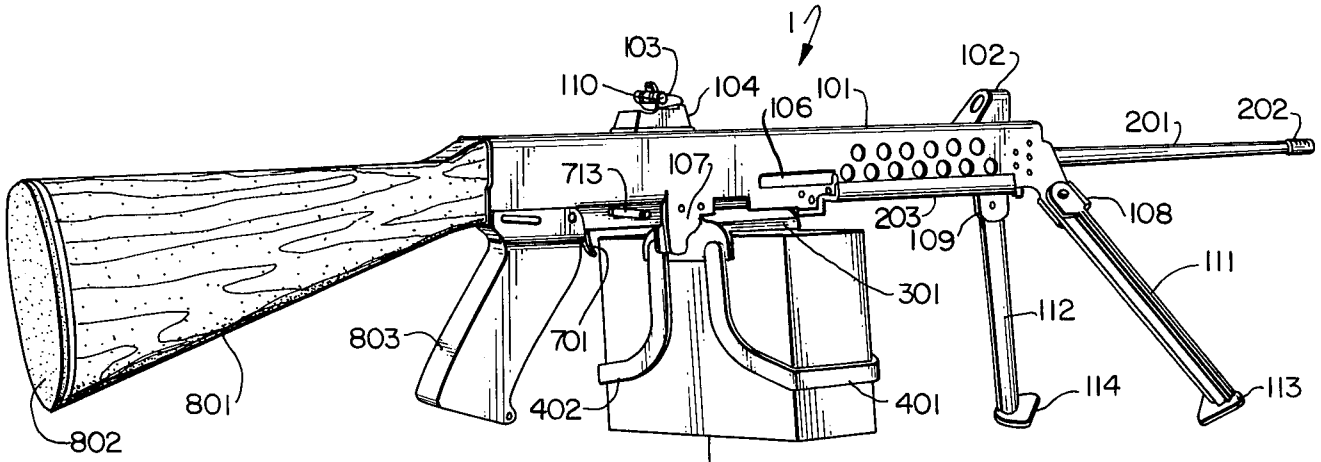
FIG. 2 is a perspective view of the machine gun showing bipods extended and the magazine in place.

Referring to FIG. 1, the gun is shown generally designated as 1. It consists of a barrel assembly 200, a receiver assembly 100, a bolt assembly 600, stock assembly 800, trigger assembly 700, feed system 300, feed advance system 500 and magazine 400. FIGS. 1 and 2 show the gun 1 in two basic positions. FIG. 1 shows the gun with its bipods removed and mounted on a standard machine gun field mount. The gun has receiver 101, front sight 102, rear sight 103 and its support 104, windage knob 110, bulkhead 105, ejection port 106, advance cam flange 107, bipod tabs 108 and 109, barrel 201, muzzle 202, barrel support 203, stock cushion 802, stock 801, grip 803, trigger guard 804, trigger 701 and feed adapter 301 with ammunition belt B secured thereto. The gun is mounted by adapter frame 2, which is secured to gun 1 by machine screws such as 3, 4 engaging holes in the receiver. In FIG. 1, the bipod legs are removed. Frame 2 has main portion 5 which is pivotally secured to rod 7 and threadably receives elevation screw 24 and is locked thereto by knob 6. Collar 25 locks screw 24 in position and rod 7 is pivotally attached by bolt 9 to swivel 8 which is mounted for rotation on frame 10. Frame 10 has leg support section 11 which receives telescoping portion 13' of leg 13. At the base of leg 13 is plate 14 with ground engaging 15. Frame 10 also leg support section 12 and locking bolt 18 Section 12 receives upper rear leg portions 16 and 17 which pass through collars 20 and 19, respectively, to become lower rear leg sections 26 and 26', respectively. Collars 19 and 20 are joined by bar 21 having screw support 22 and collar 23 thereon. Legs 26 and 26' have plates 27, 29 and projections 28 and 30, respectively. Screw 24 is used to raise or lower the line of fire of gun 1 and member 22 will slide along bar 21 to allow the gun to traverse.

In FIG. 2, the gun is shown with bipods 111 and 112, having bases 113 and 114, respectively, in place and supported thereby. In lieu of belt B, a magazine 403 is shown attached to adapter 301. Also shown are carrying handles 401 and 402 which are capable of being swung upwardly as in FIG. 23 to enable the gunner to carry the gun. The safety latch 713 is also shown. In FIG. 2, the trigger guard 804 has been folded into grip 803. While only two positions (FIG. 1 and FIG. 2) of gun 1 are illustrated, it is obvious that many other positions are possible, e.g., bipod legs folded up and carried similar to the Browning Automatic Rifle, tank or vehicle mounting and aircraft or helicopter mounting.

Figure 3:
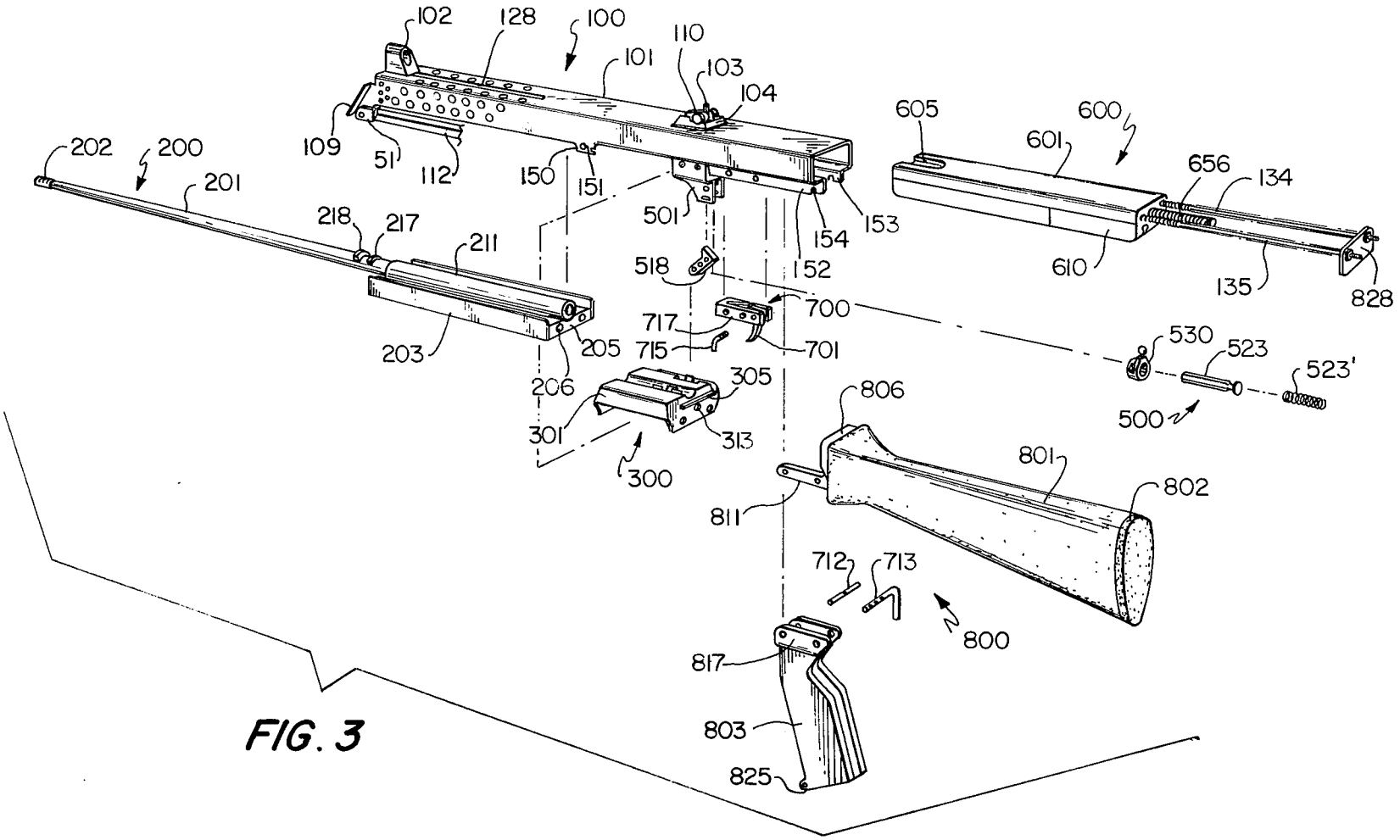
FIG. 3 is an exploded perspective view showing the machine gun stripped to its major components.

FIG. 3 shows the field stripped version of the gun 1. The barrel assembly 200 has barrel 201, muzzle 202, locking rings 217, 218, barrel grip 203, barrel chamber portion 211 and locking stud receiving holes 205, 206. Adapter assembly 300 is shown with feed adapter 301, cam drive 313 and locking bar 305. Trigger assembly 700 is shown with trigger housing 717 and trigger 701. Stock assembly 800 is shown with stock 801, stock cushion 802, receiver support 806, pivot bar 811, grip 803, grip flange 817, grip locking pin 712, stock locking pin 713 and trigger guard lock 825. Bolt assembly 600 is shown with upper bolt 601, lower bolt 610, bolt charging groove 605, guide rods 134 and 135, buffering spring 604 and buffering plates 828. Receiver assembly 100 is shown with receiver 100, front sight-charger 102, cocking slot 182, bipod tab 109, bipod 112 with swivel head 51, feed ramp flange 150 and field mount mounting hole 151, pivot bar flange 153, stock locking pin slot 154, feed cam assembly flange 501, rear sight 103 with windage adjustment knob 110 and rear sight support 104. Also shown are feed cam retraction lever 518, lower bolt cam follower 530, feed cam 523 and feed cam biasing spring 523'.

Since the weapon is made up of major sub-assemblies, each sub-assembly will be discussed in detail followed by an overall description of the weapon, its operation and the interrelationship of the major components or sub-assemblies.

RECEIVER ASSEMBLY 100

Figure 8:
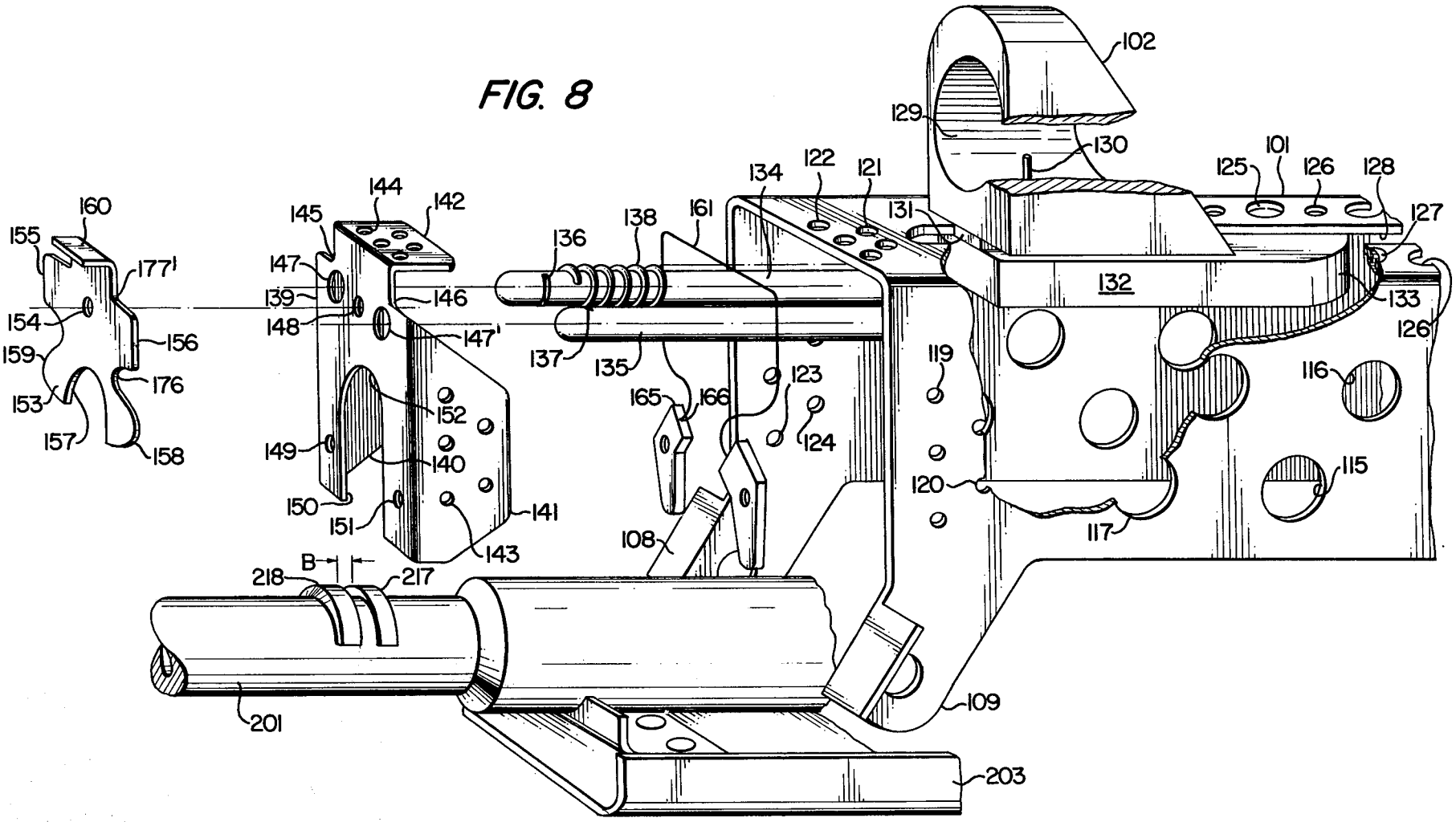
FIG. 8 is a partial exploded perspective view of the front end of the machine gun showing the bulkhead recoil buffering system.

The receiver assembly 100 is shown in FIGS. 3, 4, 5, 6, 8, 9, 10, 11, 12 and 13. The receiver 101 comprises a generally channel shaped piece of stamped metal. The rear sight 103 is a standard M3 Carbine sight mounted on a plastic support member 104 to bring it up into alignment with front sight 102. Front sight 102 is shown in detail in FIGS. 6 and 8. As shown, sight 102 performs two functions. It is the front sight of the gun and it is also the cocking handle for the piece. It consists of a plastic member with a sighting bore 129 therein. A peg 130 is mounted in the base of bore 129 and is used in conjunction with the peep sight on 103 for aiming the gun. The sight 102 is mounted for sliding movement along the top of the front of the receiver 101. A charger member 132 is secured to sight 102 by means of a pair of rivets 131' passing through both members and a spacer 131. The end of slot 128 acts to stop the forward motion of the slider charger 132 together with tab portion 142 of bulkhead 139. The spacer 131 is the same width as slot 128 while sight 102 and slider charger 132 are wider. The rear end of charger 132 is rounded (as shown in FIG. 8), and engages in slot 605 of upper bolt 601. The forward travel of bolt assembly 600 is limited both by the face of lower bolt 610 contacting the end of chamber portion 211 and by full engagement of charger 132 by slot 605. To cock the weapon, one grasps sight 102 and pulls it rearwardly until the bolt assembly 600 is cocked.

Figures 5, 7:
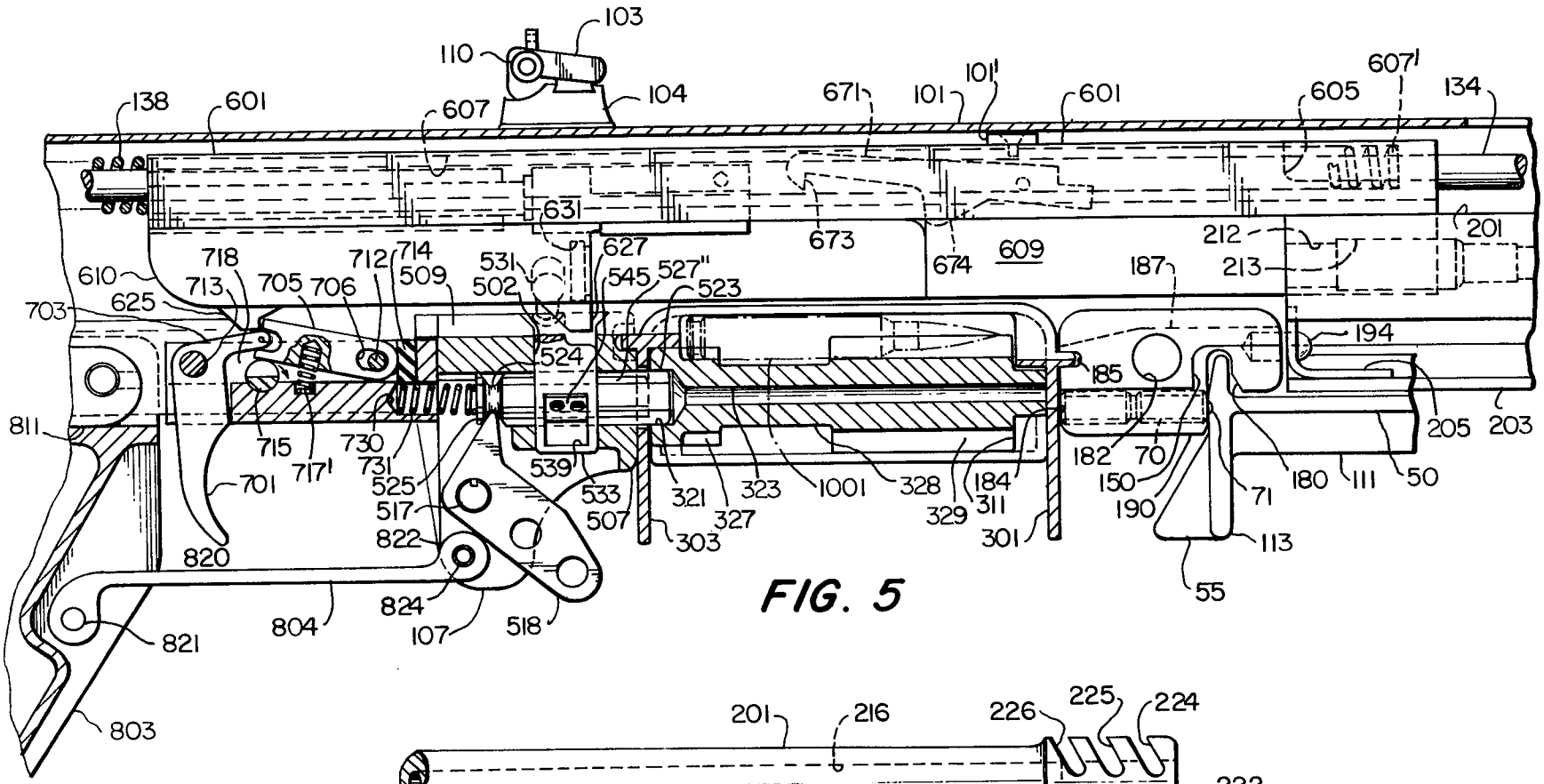
FIG. 5 is a partial sectional side view of the machine gun showing the firing mechanism feed adapter and advance, and feed ramp.
FIG. 7 is a partial side sectional view of the machine gun showing the barrel and muzzle.
Figure 12:
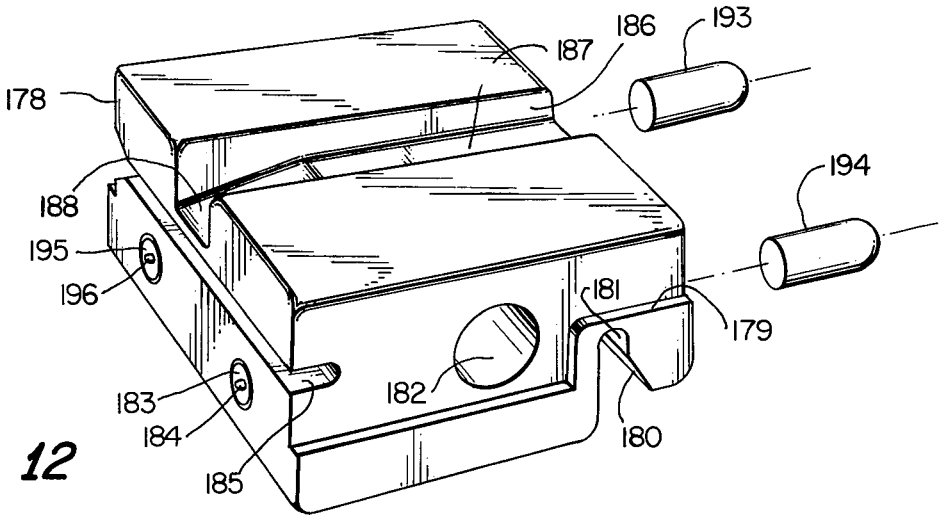
FIG. 12 is a perspective view of the feed ramp of the automatic weapon.

The receiver assembly 100 has a pair of depending flanges 150 (FIG. 5) between which is mounted the feed ramp 178 (FIG. 12). Feed ramp 178 has a groove 186 therein with guide surfaces 187, 188 at the base thereof. Ramp 178 is mounted between the feed adapter assembly 300 and the rear of the barrel chamber portion 211 (FIG. 5). A bore 182 therein is aligned with holes 151 (FIG. 3) into which machine screws 4 fit when the weapon is attached to a standard field machine gun mount (FIG. 1). The front of feed ramp 178 has a pair of locking studs 193, 194 therein (FIG. 5) which engage in holes 206 of barrel brachet 205. At the rear of feed ramp 178 are a pair of bores which receive biased plunger units 195, 183, having ball plungers 196, 184. These ball plungers are engaged to biasingly engage the front surface of assembly 300 under the rib opposite rib 305 (FIG. 20).

Figure 13:
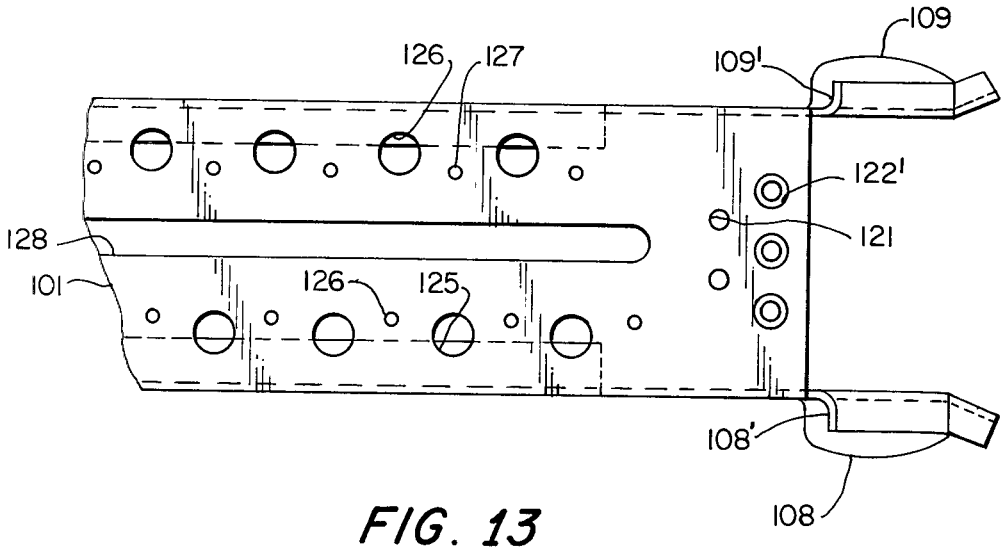
FIG. 13 is a top plane view of the front end of the machine gun.

The receiver 101 has elongated flanges 152, 153 on the rearward end thereof. The front end of the receiver, referring to FIGS. 2, 6, 8, 9, 10, 11 and 13, it is seen that the top of the receiver has stress relieving and cooling holes such as 125, 126 therein (FIG. 13). The front sides of the receiver also have stress relieving and cooling holes 115, 116 and 117 (FIG. 8). Rivets such as 126, 127 are located in the top front of the receiver to insure that the top of bolt assembly 600 doesn't ride up against the receiver.

A pair of tabs 108, 109 extend forward from the front lower edges of the receiver and are bent over as at 108', 109', respectively.

Figure 55:
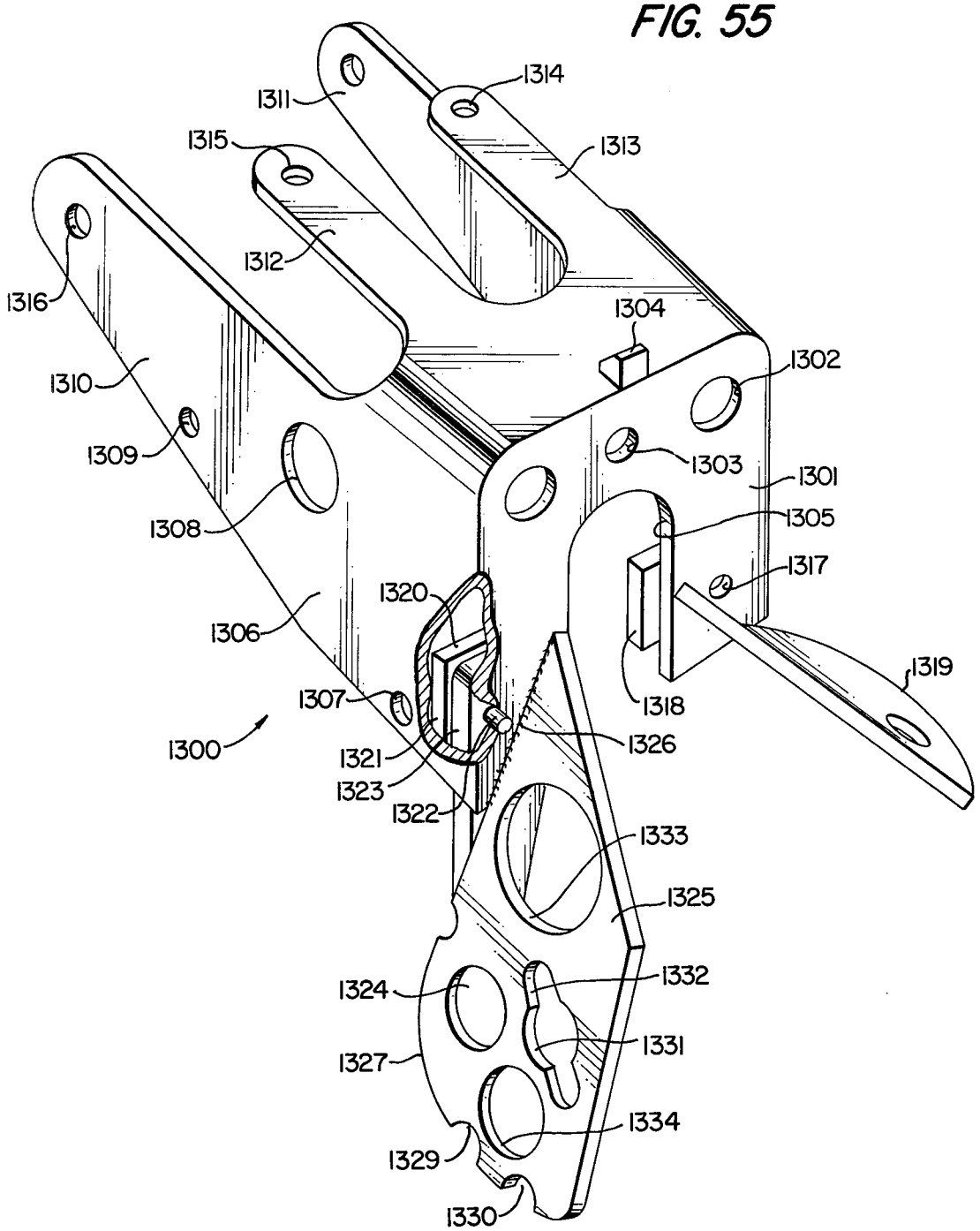
FIG. 55 is a perspective view of an alternative bulkhead assembly.

Referring now to FIGS. 6, 8, 9, 10 the bulkhead assembly is shown. It should be remembered that all the recoil forces are anchored to this assembly so that it is strongly made to absorb these forces. An alternative construction is shown in FIG. 55.

Bulkhead 139 (FIG. 8) is shown as having notched portions 145, 146 and flanges 140, 141 and 142. The front face of bulkhead 139 has holes 147, 147' for receiving the ends of bolt assembly guide rods 134, 135, respectively. Guide rods 134, 135 have slots 136, 137 therein. Hole 148 receives a rivet 171 (FIGS. 9 and 10) which secures locking member 153 thereto. A washer 172 allows locking member 153 to pivot on rivet 171. Holes such as 143 on flange 141, holes 144 on flange 142 and holes on flange 140 align with holes 119, 120, holes 121, 122 and holes 123, 124 respectively on receiver 101.

Rivets such as 169, 170 (FIG. 9) secure the bulkhead flanges to the receiver.

A central cut-out 152 in bulkhead 139 is adapted to receive the area of the barrel 201 between lugs 217, 218.

Locking member 153 has handle 160, notched areas 176, 176', 177, 177' locking tabs 155, 156, and arcuate legs 158, 159. It also has a central cut-out 157 (FIG. 8) which aligns with cut-out 152.

Member 153 is rotated to align any two of the notched areas with holes 147 and 147'. The guide rods 134, 135 with the bolt assembly 600, are then pushed forward until the slots 136, 137 are just forward of holes 147, 147'. Member 153 is then rotated and tabs 155, 156 enter slots 136, 137, respectively and lock the guide rods to the bulkhead 139.

Figure 10:
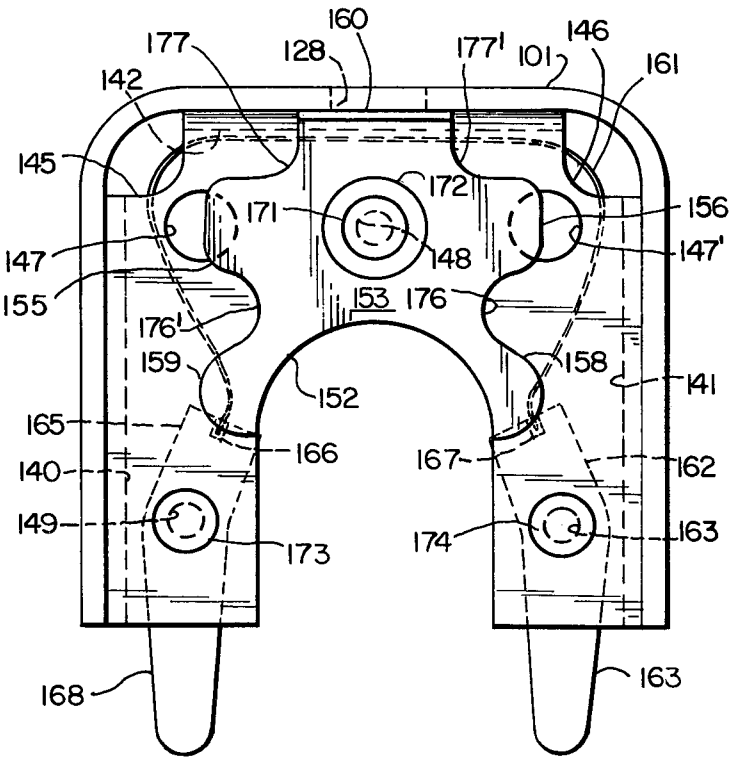
FIG. 10 is a front view of the front end of the machine gun receiver.
Figure 9:
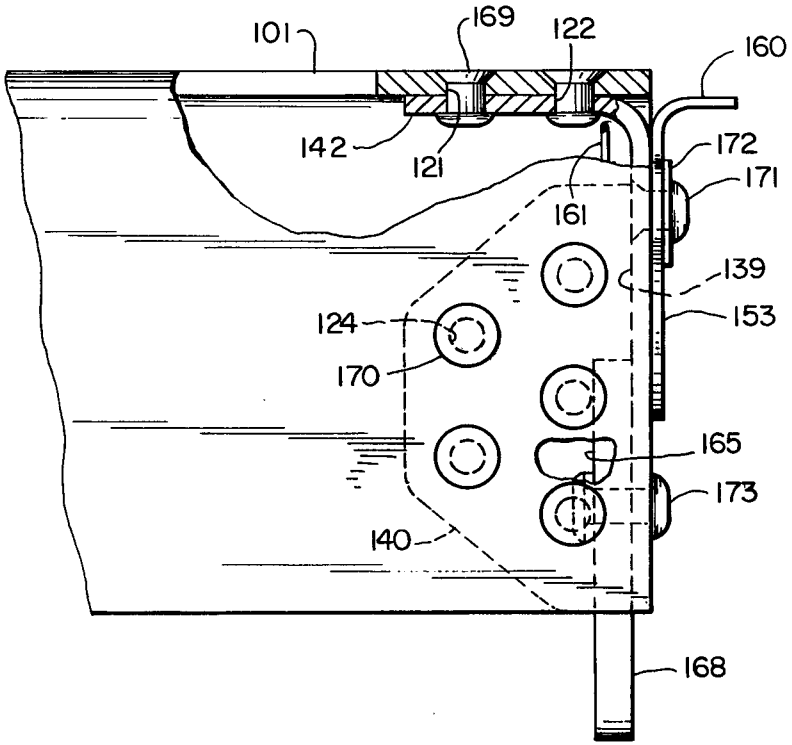
FIG. 9 is a sectional side view of the front end of the machine gun.
Figure 11:
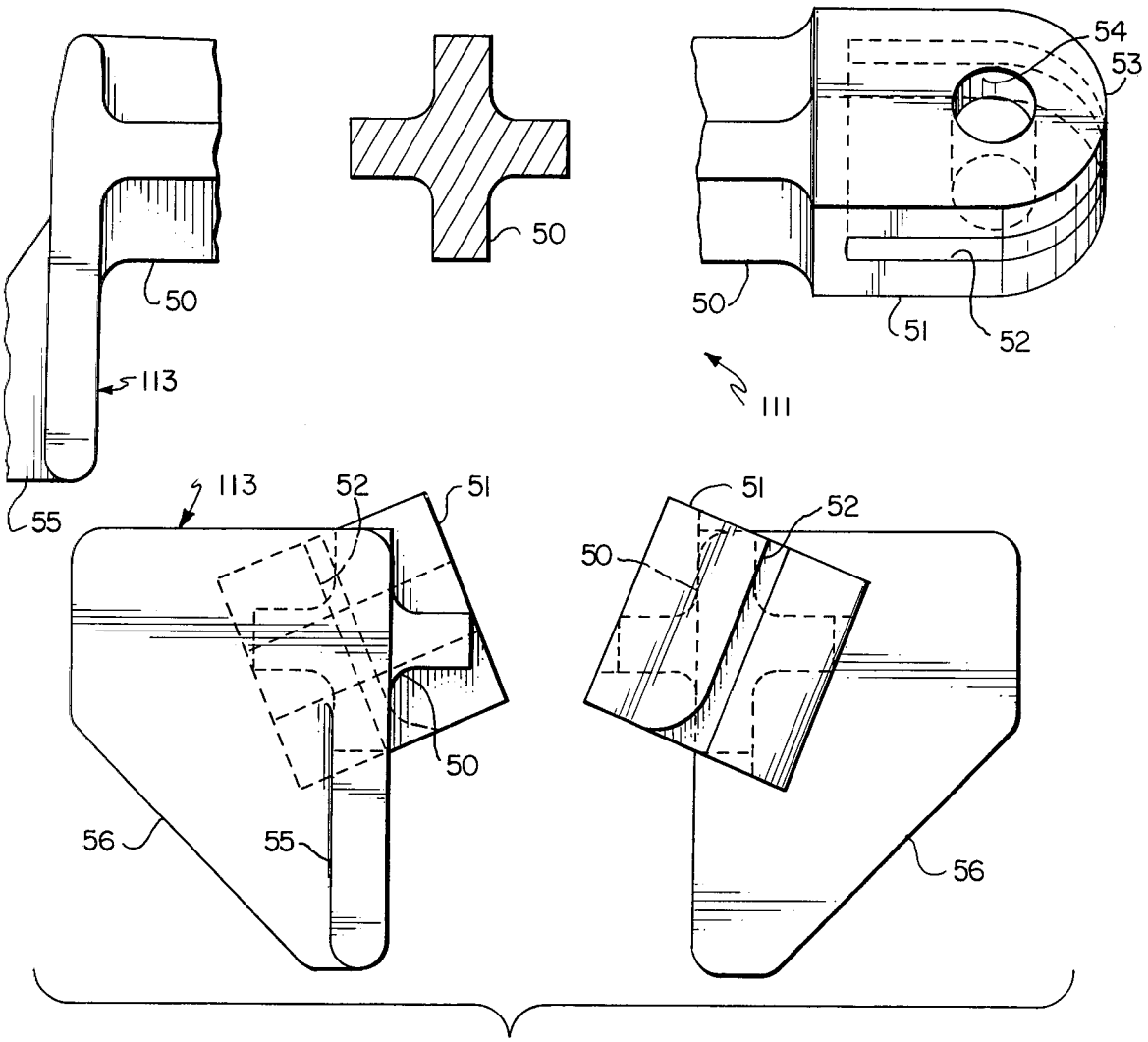
FIG. 11 is a series of partial views of the bipod legs.

A pair of rivets 173, 174 pass through holes 149, 163 in member 153 and secure locking pawls 162, 165 in place on the rear surface thereof. The tops of pawls 162, 165 have holes 167, 166, respectively, therein which receive the ends of biasing spring 161 therein. Spring 161 normally biases the pawls so that the upper inner edges protrude slightly into the area circumscribed by cut-outs 152 and 157. One can remove them from obstructing the area by pinching in on tab portions 163, 168 (FIG. 10).

Figures 4, 6:
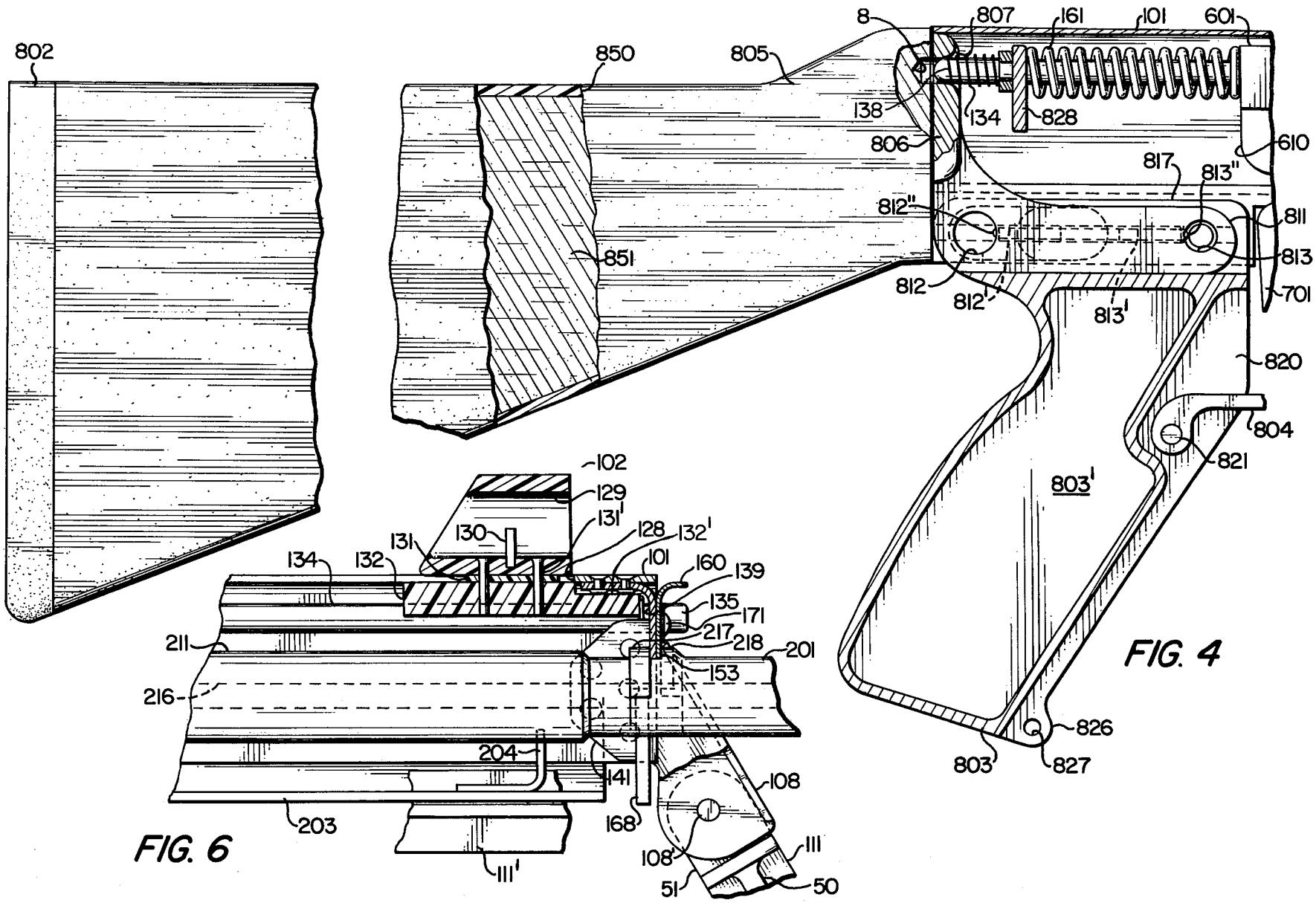
FIG. 4 is a partial sectional side view of the stock and grip of the machine gun.
FIG. 6 is a partial side sectional view of the front of the machine gun showing the recoil support bulkhead and bipods.

The width "B" between lugs 217, 218 on barrel 201 is equal to the width of bulkhead 139 and member 153 so that when the barrel is snapped up into the area circumscribed by cut-outs 152, 157, a tight fit (no front or rear movement) is accomplished and pawls 163 and 168 snap back after lug 217 forces them apart. Any downward movement of the barrel 201 merely forces the top of pawls under lug 217 (FIG. 6) to lock it in place even more securely. To remove the barrel, the gunner merely pinches the pawl tabs together, FIG. 6 shows the barrel in place on the bulkhead. The ends of lug 217 are beveled at angle "D" (FIG. 17) to obtain a flat engagement with part of the top surfaces of each pawl member.

Pins such as 108' lock bipod legs 11 and 112 to tabs 108 and 109 when the gun is used in the mode shown in FIG. 2.

Bipod legs 111 and 112 are identical opposites. They both have a representative cross sectional leg shown as 50 in FIG. 11. At the top, there are a pair of ears 51 and 53 with a tab receiving slot 52. Holes in the ears such as 65 receive pins such as 108' to secure the bipods to the receiver. At the base of each leg is a base 113 having angled side 56, beveled area 52, edge 51 and projection 55.

Ball plungers in feed ramp 178, only shown in FIG. 5, engage bases 113 to lock the bipods in the up position in groove 181 when they are not being utilized as in FIG. 3.

Barrel 201 is thus supported by studs 193, 194 of feed ramp 178 and by pawls 163 and 168 cooperating with lug 217.

I.e., the function of the receiver assembly 100 is to tie together the entire weapon. The most important subassembly the receiver shell 101 (a formed sheet metal shell holding the receiver components together) holds is the front bulkhead assembly 139. The bulkhead is the strongest point in the weapon; and thus receives the full force of the barrel thrust, transmits the recoil loads from the guide rods to the receiver, affords the attachment points for the forward bipod, transmits the dry firing load from the bolt to the receiver via the charger/buffer combination, and finally is the forward attachment point for the gun sling. The slot inserts between the two machined lugs 216, 217 on the barrel and locks the barrel securely from forward and aft movements. Because of the horseshoe configuration of the slot, the slot also affords vertical control for the barrel. To the left and right of the slot the barrel pawls 163, 168 are attached. The two barrel pawls are cammed outward against their retaining spring 161 by the insertion of the barrel into the bulkhead slot. Once the barrel 201 is fully inserted into the bulkhead the locking pawls 163, 168 prevent the barrel from dropping out of its locking recess by latching underneath the locking shoulders of lug 217.

The bolt guide rods 134, 135 are inserted through two equally spaced holes 147, 147' in the forward bulkhead and locked into position by latch 153 on the bulkhead that is free to rotate only when the barrel is removed. The guide rod latch is configured so tabs 155, 156 are inserted into matching notches 136, 137 in the bolt guide rods. This engagement gives positive control to the bolt guide rods in the forward and aft directions. The close fitting of the guide rods in the bulkhead control radial movement. Bipod legs 111, 112 are attached to the forward bulkhead flanges or tabs. The flange is bent 25° to give the bipod legs an acute stance of approximately 50°. The bulkhead 139 is attached to the receiver shell by 15 rivets, five rivets pattern on the three tab extensions of the forward bulkhead. The bulkhead tabs secure the bulkhead assembly to the sides and top of the receiver shell.

The most critical function the bulkhead has is to hold and maintain alignment of the barrel to the receiver. The width of the semicircular 152 cut into the bulkhead must match quite closely the root diameter of the lug surfaces on the gun barrel. Currently, the material used are two sheets of 4130 steel sheet of 1/16-inch thickness. Other suitable materials can be used if sufficiently strong. These two shees when welded together form a flange thickness of 0.125 inch. The matching notch in the gun barrel is 0.130 inch. Some clearance is needed because the gun barrel is inserted at an angle up into the slot. In addition to the close tolerancing of the bulkhead flange to the gun barrel locking lugs, the attachment points for the barrel pawls are important. If the barrel pawls are not equally spaced so that both pawls engage on the barrel locking shoulder, one latch will take an undue beating and might fail under adverse conditions.

Another critical interface the bulkhead must have is in the positioning of the guide rod attachment latch 153. The latching tabs 155, 156 of this latch should be equally spaced so that the loads transmitted by the guide rods are equal. If one attachment tab is slightly shorter than the other or thinner than the other, and the notches in the guide rods are equally spaced; one guide rod will transmit all of the recoil loads to the forward bulkhead.

Under the current bipod design, the included angle of bipod attachment legs is important for proper folding against the forearm. Also the reinforcing flange, bent 90° to the bipod, acts as a forward stop for the bipod leg.

MODIFIED BLOWBACK SYSTEM

Figure 14:
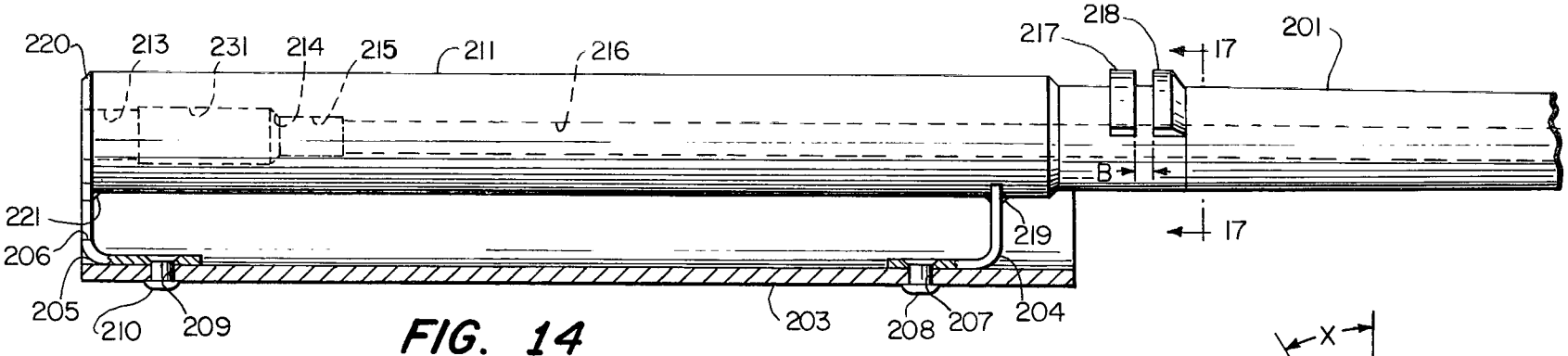
FIG. 14 is a partial side view of the chamber portion of the barrel.

Referring now to FIGS. 14–19, there is shown the barrel, muzzle and chamber assembly generally designated as 200. It consists of a tapered barrel portion 201 having a muzzle 202, a uniform diameter barrel portion 211 and a hand grip 203. Referring to FIG. 14, barrel portion 211 is shown as having a pair of angled attachment members 204, 205 secured thereto as at 219, 221 such as by welding. Member 205 has a pair of lug receiving holes such as 206 (see FIG. 3, also) for reception of lugs 193, 194 (see FIG. 12).

Holes such as 207, 209 receive rivets 208, 210 to secure the base of the members 204, 205, respectively, to hand grip 203. Grip 203 has a plurality of holes (not shown) therein to facilitate the flow of air around the barrel portion 211 to provide cooling therefor.

Figure 17:
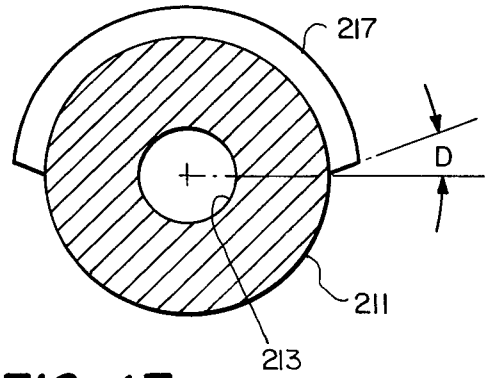
FIG. 17 is a sectional view of the machine gun barrel showing one of the locking rings.

The end of portion 211 is bevelled as at 220. The tapered portion 201 has a pair of locking lugs 217, 218 which fit on either side of the bulkhead 139. FIG. 17 shows a sectional view of the barrel showing bore 213 and lug 217. Lug 217 extends, at its extremities, 180° around portion 211, but is bevelled away at an angle D which is less than 90°.

Figure 15:
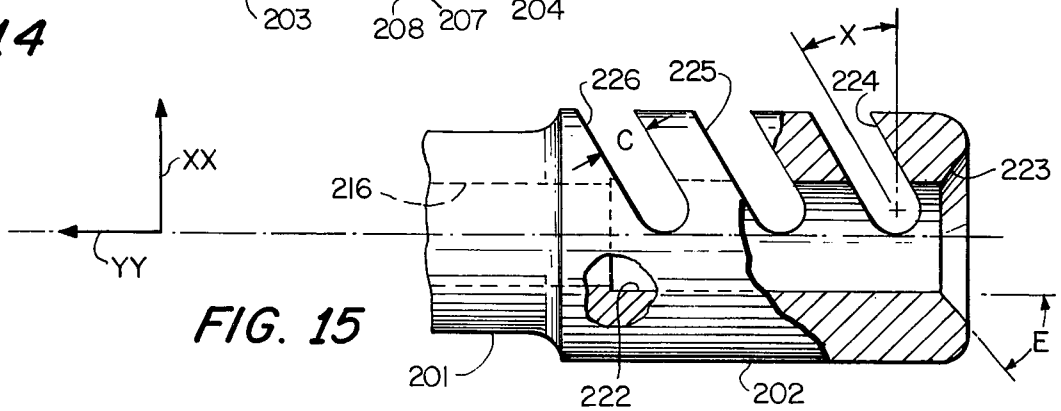
FIG. 15 is a side view of the machine gun muzzle.

Muzzle 201, shown in FIG. 15, contains a continuation of bore 216 which is slightly enlarged as at 222. Slots 224, 225 and 226 are cut at angle X in the muzzle and have width C. The bore extension is tapered as at 223 at angle E.

Figure 16:
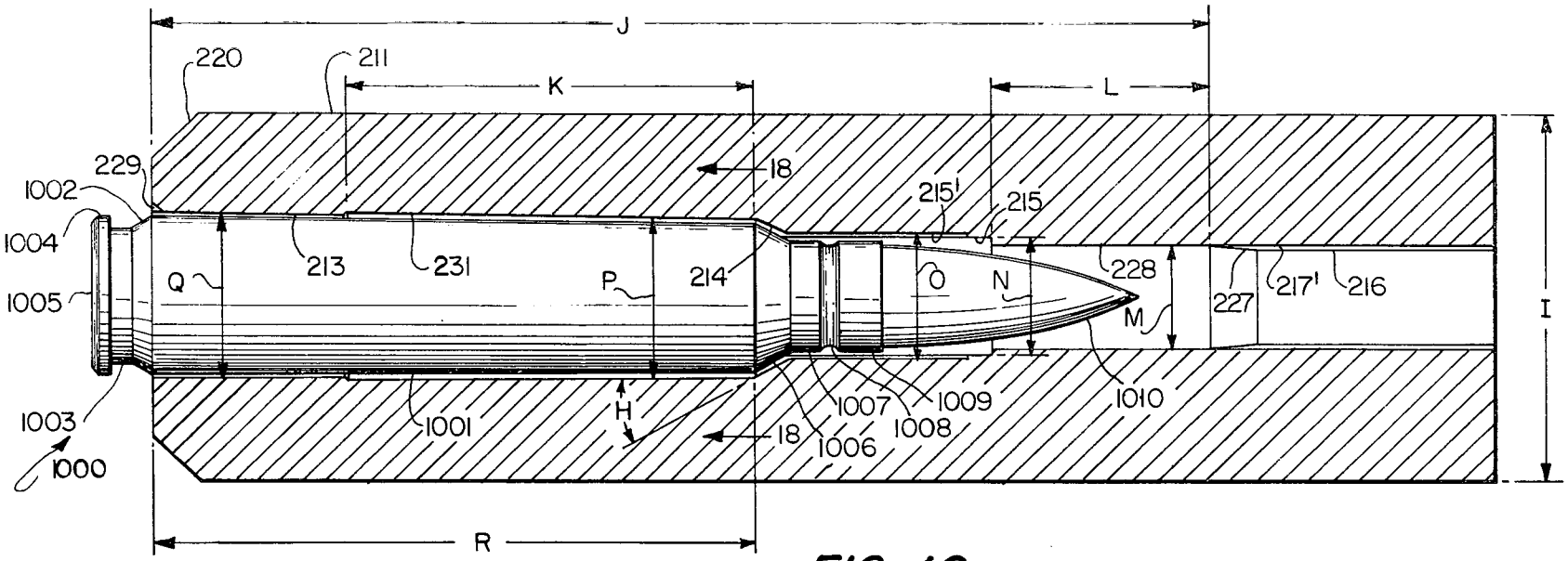
FIG. 16 is a sectional side view of the chamber portion of the machine gun barrel showing a cartridge in place.
Figure 18:
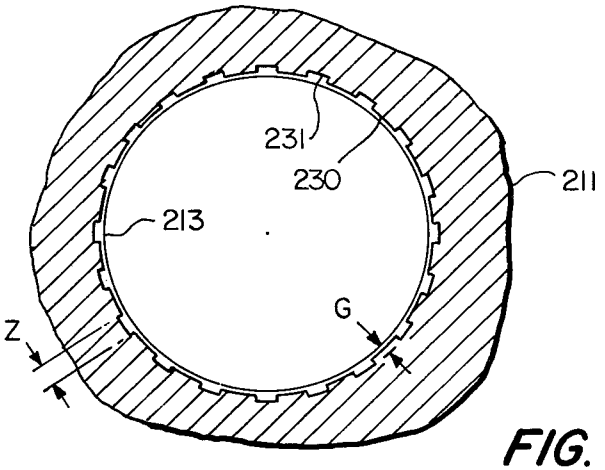
FIG. 18 is a partial sectional view taken along line 18—18 of FIG. 16.

Referring to FIGS. 16 and 18, the inside of the chamber portion is shown. The main chamber has a diameter P and is fluted as at 230 to provide grooves 231. The difference in the radius of smooth chamber 213, and of the grooves, which have diameter Q, is shown as G. The width of the grooves is shown as Z in FIG. 18. The grooved chamber is shown as tapering at 214 by angle H into grooved chamber portion 215 having grooves 215' with a diameter O. Intermediate chamber portion, having diameter N, 228 extends from portion 215 to bore 216. Bore 216 has spiral grooves 217' which taper as at 227 into portion 228.

A round 1000 is shown positioned in the chamber 213. The round has a casing 1001 which is necked down as at 1002 to base or head portion 1003 on which is flange 1004 having a rear face or firing portion 1005.

Casing 1001 is tapered at 1006 to form neck portion 1107 which, in turn, is pinched at 1008 against slug 1010.

The muzzle is designed to eliminate one-third of the kick. The angle X is approximately 30° which blows slightly more than two-thirds of the muzzle blast up at right angles to the gun, and one-third of the muzzle blast backwards. This, in effect, gives two force vectors, one backwards towards the chamber and another, more than twice as strong, upwards. Muzzle 202 is integral with the barrel 201, and the effective area is the three areas delineated by the cuts in the muzzle. Portion 211 of the barrel acts as a heat sink. The total barrel is designed to weigh about two pounds, and can be quickly changed to substitute another barrel of the same or of a different caliber. Because of grip 203, a firer in the prone position can quickly change barrels without burning his hands. The holes in grip 203 provide access for cooling air and egress for particles that may get entrapped in the receiver assembly 100. Members 204 and 205 are of stainless steel construction to prevent any large amount of heat transferring to the grip 203 from the barrel assembly 200.

The chamber portion is grooved as at 231 to provide a means for grasping the cartridge at its base during firing. These grooves allow escaping gases from the firing to exit rearwardly along the surface of the shell casing 1001 toward its base. As the projectile or slug 101 exits along the bore and the pressure within the cartridge 100C decreases, the cartridge grips the unfluted area. As the gas expands, i.e., it flows down along the external portion of the shell 1001 toward the rear face 1005 of the cartridge. During this time, the pressure is continuing to buildup within the cartridge. In the area of fluting or grooving, the cartridge will cease to grip the chamber wall, but will tend to grip the chamber 213 wall in the area between grooves 230 and tapered end chamber enhance 229. This action tends to push the rear face or head 1004 off the cartridge, thereby stretching the cartridge. If this were allowed to continue, its possible that the rear face 1005 might be blown out of the cartridge. However, simultaneous with that buildup, there is a buildup in pressure in the grooved or fluted area 230 which tends to act along the axis of the chamber around the periphery of the cartridge and thereby tending to push the entire casing rearward. This action breaks the seal between the smooth walled section of portion 213 and the upper end of the casing 1001. Therefore, there is a momentary gripping action during the initial stage of the pressure buildup. Subsequently, the pressure buildup in the grooved area releases the cartridge. This two stage action allows for a holding action to allow the gases to exit forward only, thus providing the necessary velocity to projectile 1010 and then releasing the cartridge to the rear.

Figure 19:
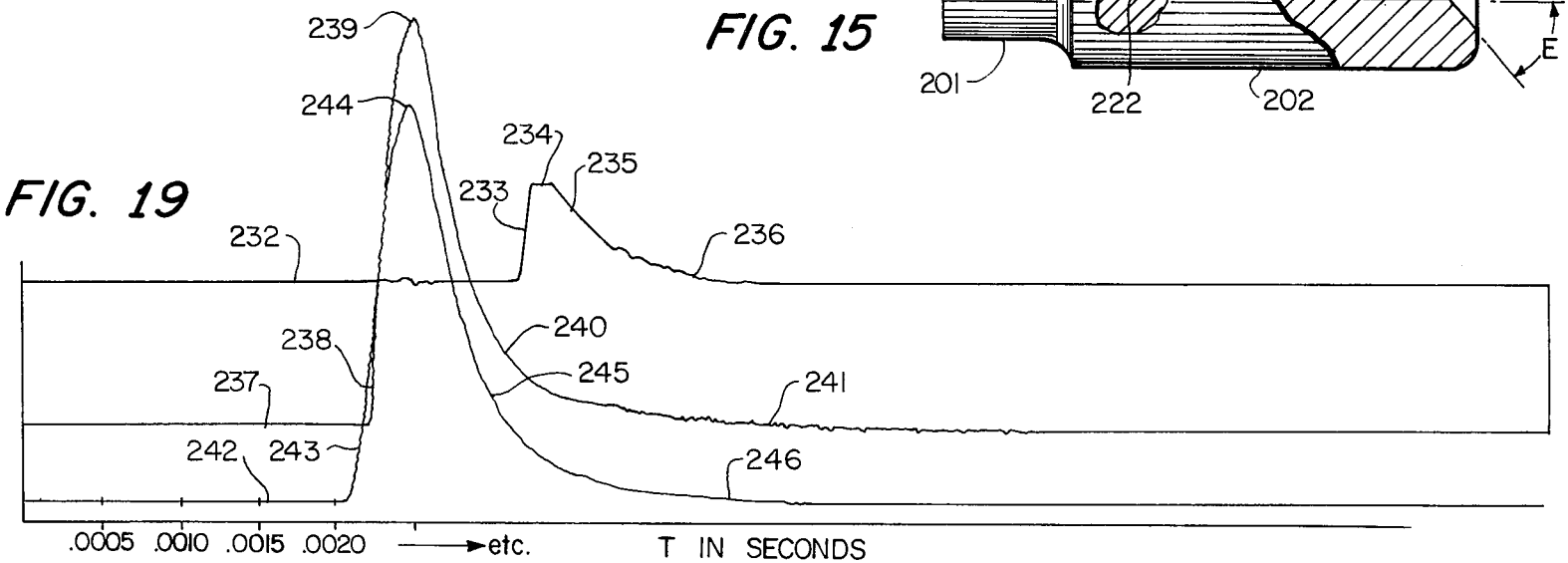
FIG. 19 is a graph showing a pressure-time plot of firing within the barrel of FIG. 16.

FIG. 19 shows the time pressure plot during the firing at three different points. Within a barrel, pressure readings are usually taken at three distinct points. The first of these being in the receiver portion opposite the shell casing, referred to as the chamber pressure (CP) and represented by plot 242. The second point is in the initial portion of the chamber located in front of the projectile prior to firing, referred to as the throat pressure (TP) and represented by plot 237. The third point at which pressure is read is at the fore end of the muzzle, referred to as muzzle pressure (MP) and represented by plot 232. Most weapons of a nature similar to the instant invention operate so that the throat pressure (TP) buildup legs the chamber pressure (CP). I.e., the portion 238 of plot 237 would not overlap portion 293 of plot 242. The resulting gap would tend to blow the head 1004 off the casing. As shown in the graph, the TP peaks at 239 above the peak of the CP at 244 and then tapers off as at 240, above CP taper 245 and levels off at 241, still above the leveling off at 246 of the CP.

The pressure at the muzzle rises later as at 233, peaks at 234, tapers off at 235 until leveling off at 236. As the projectile paasses down the bore, pressure recedes rather rapidly except in the grooved area. Upon ignition, the casing moves rearwardly approximately ten-thousandths of an inch prior to the gripping action of the grooves 230 taking place and after the gripping, (2) an elongation of the casing itself occurs which is approximately between ten and fifteen thousands of an inch. Both these movements of the head 1004 of the casing and the final release of the casing through the action of the gases in the grooved area a great deal of stored energy is transmitted to the bolt. This force moves the bolt rearwardly so as to provide access for the next cartridge. As the bolt assembly 600 moves rearwardly it activates the feed mechanism which forces a cartridge into position to be fed into the barrel. Of all the contributing forces, the second force, i.e., the stretching or elongation of the casing contributes the majority of the rearward energy to the bolt assembly 600. The initial rearward movement of the casing also contributes. These two forces give the bolt its rearward energy. I.e., this first twenty-thousandth of an inch movement overcomes the inertia of the static bolt. At the end of this movement there is a velocity which then rises due to the action of the cartridge being loosened and moving rearwardly.

After approximately three-eighths of an inch rearward movement, the velocity of bolt assembly 600 falls off. However, in the space between twenty-thousandths of an inch and three-eights of an inch, the velocity increase imparted to the bolt gives it sufficient momentum to move rearwardly.

The advantage to this system is that by controlling the gripping action on the cartridge one can control the rearward velocity of the bolt. This is different from any known machine or submachine gun system.

Factors affecting this gripping are several. Among them is the clearance between the chamber and the cartridge noted as G in FIG. 18. Another factor is the length of the grooved area 230, noted as K. Still another factor is the shape of the projectile itself and the last is the material or structure of the shell casing itself. This system, i.e., gripping and then releasing, allows use of a much lighter weight bolt than a weapon employing standard blowback technology would require. One can use a bolt weighing approximately one-third of the standard bolt weight. The gripping action is self compensating since by cutting the cartridge charge in half one only affects a twenty percent reduction in bolt velocity. Thus a buffering effect is caused by the interaction of the grooves, the expansion which tends to be self-compensating and the projectile. One can, therefore, control the projectile velocity without substantially affecting the bolt velocity.

The instant invention operates at about 45,000 psi, much higher than submachine guns. The blowback system employed is significantly different than heretofor used. Only submachine guns have used blowback technology and they have mostly employed straight blowback technology. A few have used a mechanical roller and cam to affect a delayed blowback. The firing in such submachine guns imparts energy initially to withdraw rollers in recesses before propelling the bolt rearwardly. Such a mechanical system necessitates more parts, friction, wear, etc. With the instant invention, the transition is much smoother and continuous; there is no "jump" and there is no stopping in the instant invention. While flutes or grooves have, in some chambers, been employed, they have never been employed for momentarily allowing part of the casing to lock to the chamber wall and allowing the remaining part to elongate. They are usually employed to free the neck area of the casing, an entirely different intent, i.e., to aid in extraction where bottleneck cartridges are used.

In the instant weapon, 90–95 percent of the initial rearward motion of the bolt is imparted by the case locking action. As shown in FIG. 16, the fluted or grooved area is approximately two-thirds of the main chamber length, i.e., the ratio of K/R is approximately ⅔. The letter J denotes the length of the entire chamber area, I denotes the barrel diameter and L represents the length of the unrifled portion of the bore.

By increasing G, FIG. 18, by one-ten thousandths of an inch, the bolt velocity is cut approximately in half. This happens since the casing expands the full additional amount to grip the chamber walls.

Again referring to FIG. 19, the initial burn forces upon ignition, moves the projectile into the unrifled or free bore portion 228 having length L. This causes the overlap of the plots of the TP and CP in FIG. 19. The main propellant burn then takes place, thus forcing the projectile down the bore 216, and simultaneously causing the casing to grip the grooved walls of chamber 213. When the gases float down in grooves 231 to thus release the lower portion of casing 1001, the pressure CP and TP begin to decline in the graph.

FEED ASSEMBLY

Figure 26:
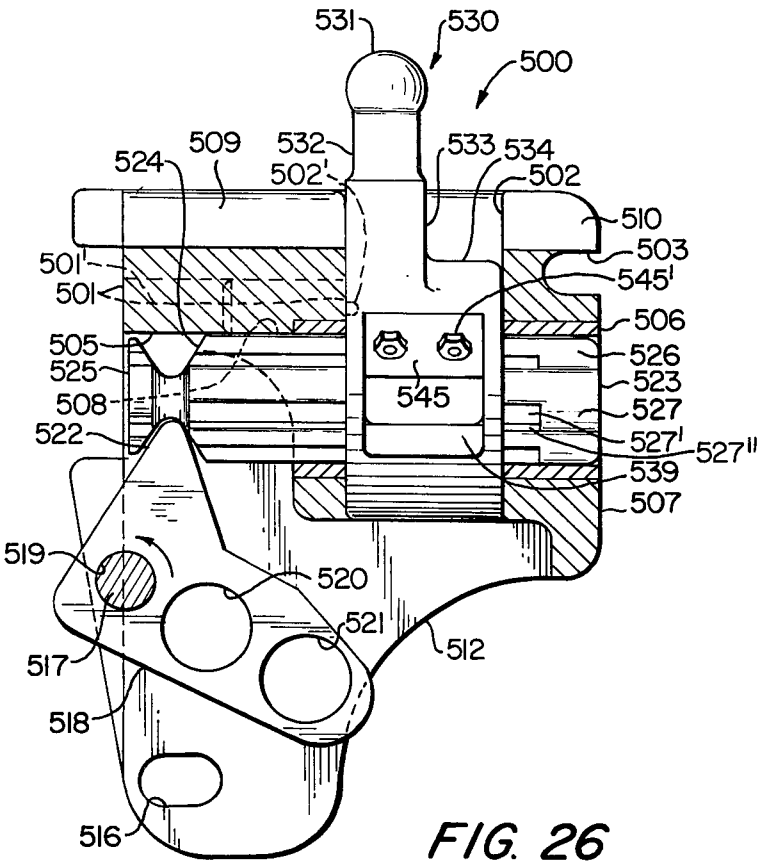
FIG. 26 is a side sectional view of the feed advance system cam mechanism.
Figure 29:
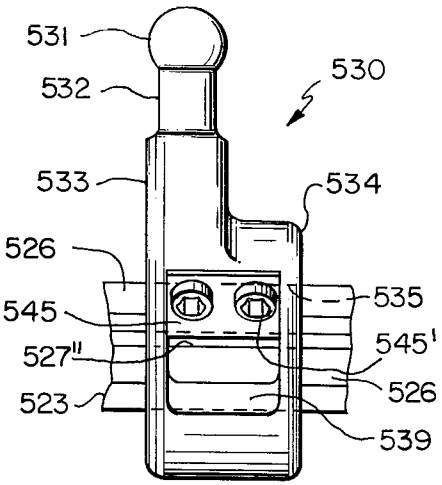
FIG. 29 is a side view of the bolt cam follower of the machine gun.
Figure 30:
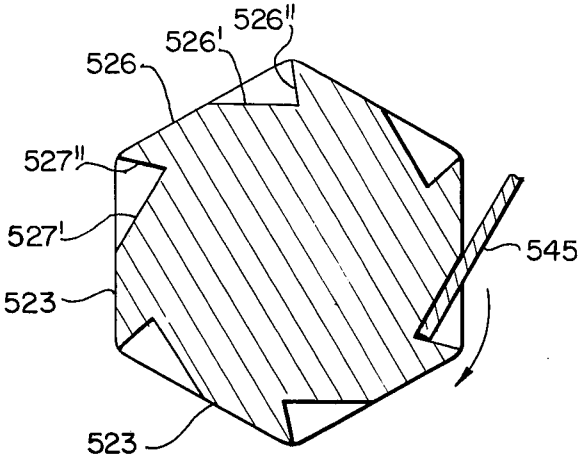
FIG. 30 is an enlarged cross sectional view of the rotary feed cam.
Figure 28:
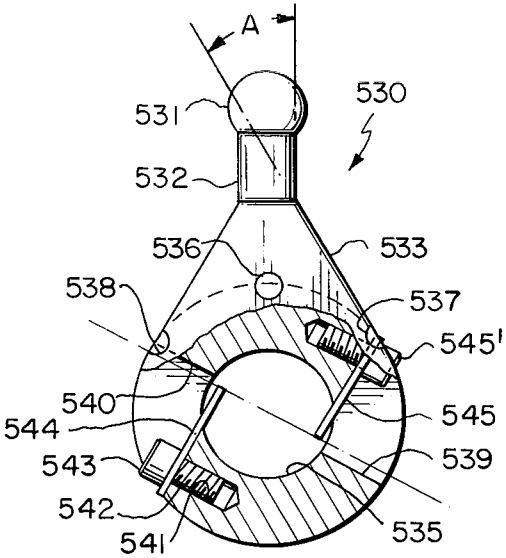
FIG. 28 is a front view, partially in section, of the bolt cam follower of the machine gun.

FIGS. 20–22 show the mechanism for feeding belted rounds to the automatic weapon and it is generally designated as 300. It comprises a mounting member 301 consisting of a stamped housing of sheet metal such as 302. A pair of flanges 303, 303' extend downwardly from member 301 and have a pair of holes such as 306, 307 therein. The holes are adapted to overlie apertures such as 406, 407 in ammunition box 400 (FIG. 20). A pair of locking lugs 304, 305, are positioned on the member to lock it within weapon 1. These lugs are elongated and fit within slots, such as 185 on feed ramp 178 and 503 on advance mechanism 500 (FIG. 26).

One side of the housing is bowed as at 308 and an arcuate notch 310 is cut on one side of the housing and an arcuate surface 309 is found on the opposite side thereof. A support frame 311 provides a groove 312 to cooperate with the rotary feed member 320. A hole 313 in one end of mechanism 300 provides access for driving lug 523 of the advancement mechanism 500. Lug 523 is adapted to engage hexagonal aperture 321, having tapered portion 322 and bore 323 of rotary feed member 320. Lug 523 provides rotation of member 320.

Member 320 has a series of six detents such as 325 equally spaced around the driving end 324 thereof. These detents are adapted to receive detent ball 317 which resides at the base of aperture 314. A spring 316 biases ball 317 against portion 314 and, in turn, is kept in place by set screw 315.

Portion 324 has six equally grooves 326 cut therein for receiving the ends of rounds $B_2$ through $B_4$. A narrowed neck portion 28 connects portion 324 with grooved section 332 which has six elongated grooves such as 329, 330 therein for receiving the fore or neck portion of cartridges. These grooves are aligned with grooves 326, 327. A reduced diameter collar portion 331 is adapted to rotate within a hole (not shown) in the other end of housing 301. A bushing 340 maintains the other end of member 320 in alignment.

Housing 301 is cut away as at 318 to provide an exit for clips such as C. A spring 334 is attached to the inner upper portion of housing 301 and a pair of extension portions 335 and 336 which act to keep the rounds, such as $B_2$, in place in the grooves 326, 330 until portion 627 of bolt 600 engages the rear face of the cartridge to push it forward on the feed ramp toward the chamber. As the cartridge is forced forward the clip C, a standard clip which holds the cartridges together, is detached and exits sideways through cut-away area 318. A guard member 337 having ramp portion 38 is attached to the underside of housing 301. The ramp portion 338 aids in insuring prompt and accurate exit of clip C.

The edge 333 (FIG. 20) of portion 312 aids in keeping the cartridges in place until they are engaged by portions 335 and 336. The ball 317 cooperate with detents 325 to maintain the member 320 in place between firings. After a round has been fired, the bolt assembly 600 starts rearward and lug 523 begins to rotate member 320 to bring another round into position. As portion 627 of the bolt clears the member 301, the next round enters the area between 309 and notch 310. The member 301 may be provided together with the ammunition box 400 or be provided separately.

AMMUNITION BOX

Figure 25:
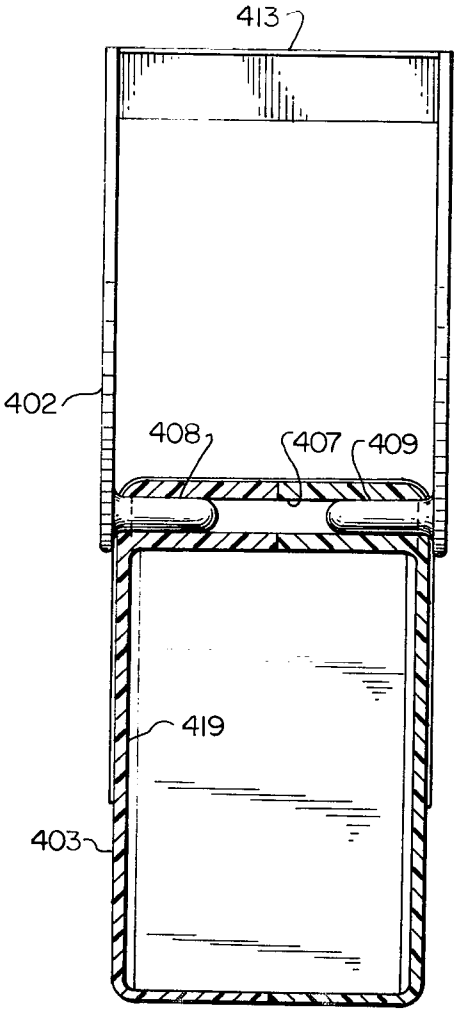
FIG. 25 is a sectional side view of the magazine.
Figure 23:
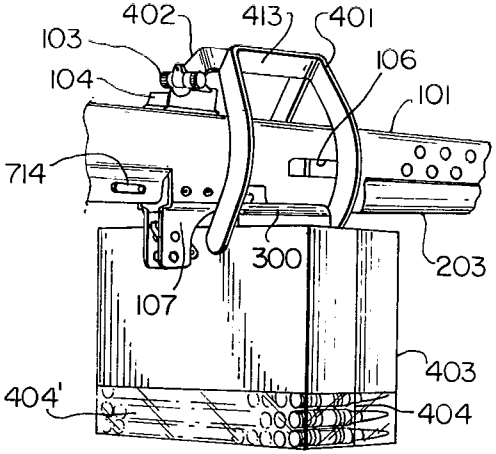
FIG. 23 is a partial perspective view of the magazine gun with carrying handles in carrying position.
Figure 24:
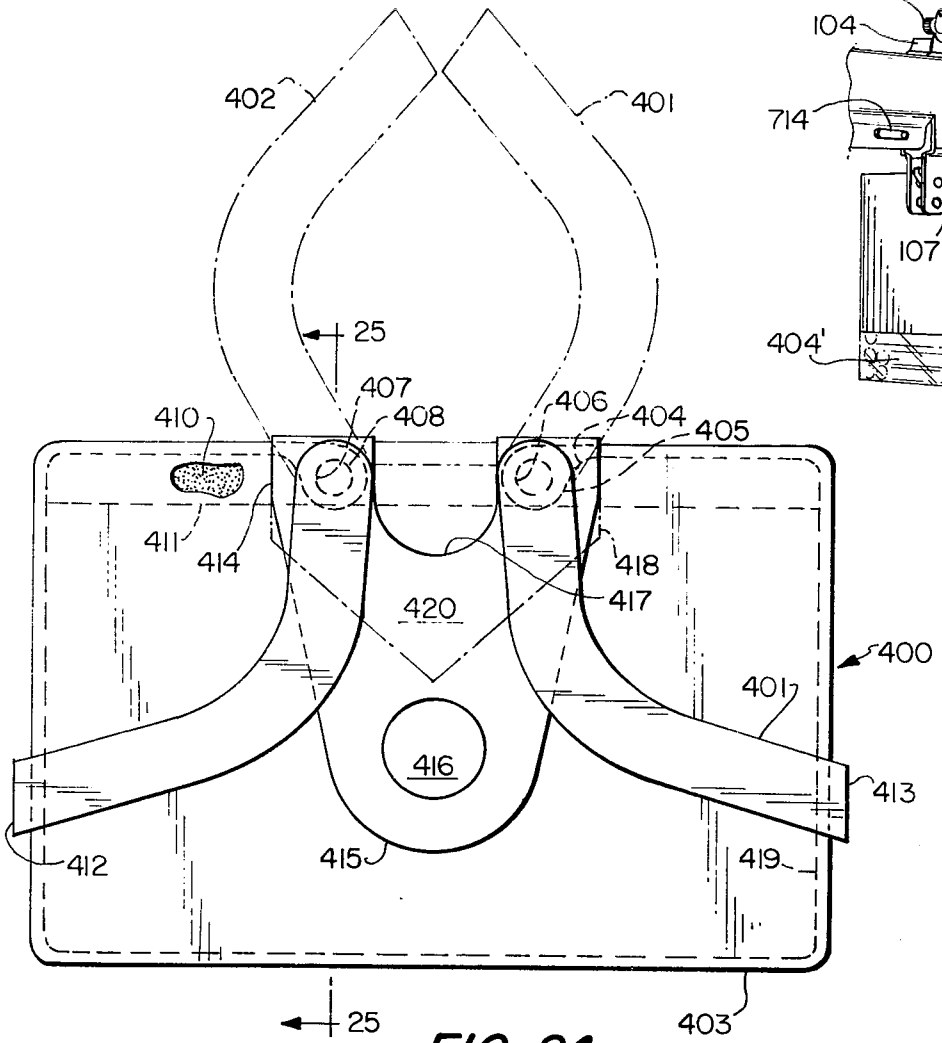
FIG. 24 is a front view of the magazine.
Figure 27:
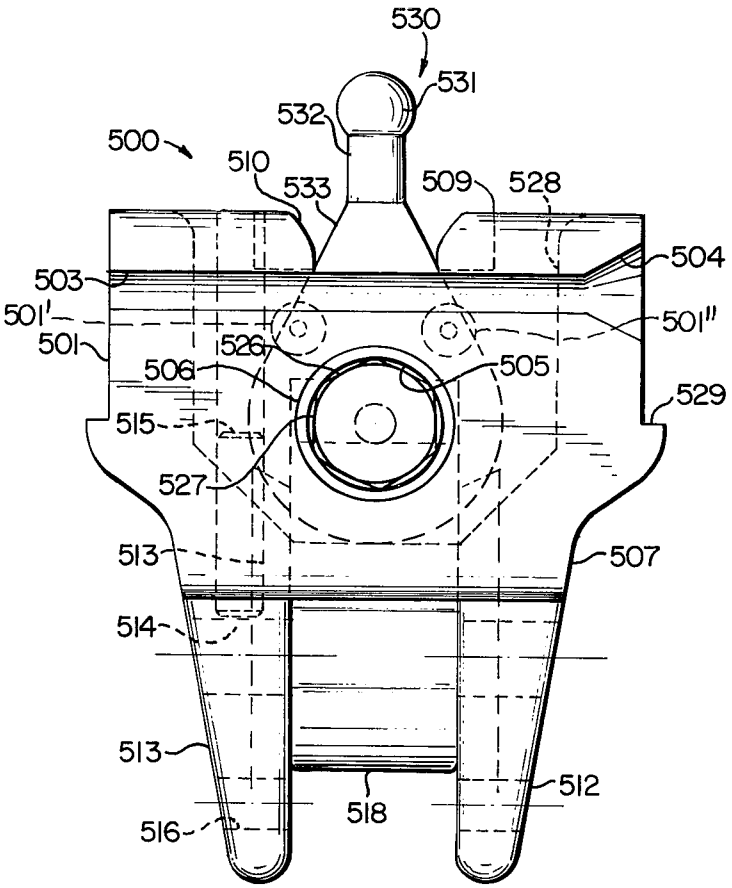
FIG. 27 is a front view of the feed advance system cam mechanism.

FIGS. 23–25 show the ammunition box 400. It comprises a housing 403 having thickened portions as at 404 to provide cylindrical portions such as 405. A pair of bores 406, 407 are located in said thickened portions. Between the portions is located a central opening which provides the egress for belted rounds of ammunition to feed to the weapon. Rules 411 of plastic 410 extend from the thickened portions to the end walls. The inside of the box has smooth sides as at 419 and has an inside width approximating the length of whatever size round is being employed, e.g. 0.30 caliber, 0.50 caliber or 20mm. Naturally, the weapon and its various components are of a proportional size also. A pair of handles 401 and 402 are attached to the box. They are pivotally mounted by projections such as 408 and 409 and have a central carrying grip portion such as 412 and 413. The handles are shown in their down position in FIG. 24 and in FIG. 2. FIG. 2 shows the handles also securing assembly 300 to the box. FIG. 23 shows the handles in carrying position. It should be noted that the handles can be used to carry solely the ammunition box or to carrying the weapon when the box is attached thereto.

A piece of Mylar R tape 420 is used to seal the box. This tape has a diamond shaped terminus portion on one side (shown by the dotted lines) and a tap portion 415 on the other side. The tape is adhesive everywhere except over the opening on top of the box and in the circular area 416 which is used to grip the end of the tape to tear it off the box and unseal it.

The base of the box may be made transparent as at 404 and 404' so that the gunner can tell when the ammunition is about to be expended and another box is needed.

The box is lightweight and is disposable due to its plastic construction. Assembly 300 may be provided with the box with the seal underneath it. To load the weapon, the assembly 300 is removed by detaching the handles. The handles are made of pliable plastic and thus can be bent outwards to remove portions 408, 409 from the bores.

The tape is then removed and the handles snapped back in place to secure the assembly 300 in place. The whole unit is then slid sideways into the magazine area of the weapon. The weapon must be charged prior to sliding in assembly 300. Once assembly 300 is in place the weapon is ready to fire.

FEED ADVANCE ACTIVATING ASSEMBLY

Referring now to FIGS. 5 and 26 through 30 there is shown the assembly 500 for activating the feed advance assembly 300. The assembly 500 comprises a frame member 501 having a central chamber 502 therein. A notch 503 relieved as at 504 extends across the frame 501. Notch 503 receives one of the guides 305 of assembly 300 while notch 185 of feed ramp 178 (FIG. 11) receives the other, thus locking assembly 300 in place. A central bore 505 extends longitudinally of frame 501 and has a bushing 506 surrounding a portion of it. The lower portion of frame 501 is curved and tapered as at 507 and extends downwardly to form a pair of flanges 512 and 513. At the base of flanges are a pair of holes such as 516. A pin 517 extends through the flanges and is received within bore 519 in pawl 518 which has lightening holes 520, 521 therein.

The top 509 of assembly 500 is split as at 510 and has a ridged relief 528 adjacent chamber 502. Projection 627 on lower bolt portion 610 rides through the split portion of top 509.

A pair of bores such as 508 receives a pair of spring biased members such as 501' and 501''. Members 501' and 501'' have biased projections such as 502' which tend to extend slightly out into chamber 502.

Located within bore 505 is pawl member 523. It has a rear face 525 and a reduced diameter area 524 which receives projection portion 522 of member 518. By rotating member 518 one pawl can advance or retract 523 within bore 505. Member 518 is biased clockwise so that pawl 523 normally projects out of the front of bore 505. A spring 515 acts to engage pin 517 with bore 514 of flange 513. Spring 515 is received within bore 513. FIG. 26 shows member 518 and pawl 523 is biased condition so that assembly 300 can be slid sideways into the receiver and grooves 503 and 185.

Pawl 523 has a hexagonal shape with faces such as 526, 527. A series of slots such as 526' and 527' are cut into each face. Each slot has a "back angle" face such as 526'' and 527'' which is approximately 5° (see FIG. 30).

Surrounding pawl 523 and mounted in chamber 502 in cam follower 530 which acts as a ratchet. It consists of follower head or ball which is adapted to ride within and from end to end to cam 614 in lower bolt portion 610. The follower 530 is only at rest when tipped left or right. In the position shown in FIGS. 26, 27, 28 or 29, the follower would be at midtravel in cam 614.

A neck portion 532 connects ball 531 with the main body portion 533. Portion 533 has a bore 535 and is cut away as at 539 and 540. Threaded bores such as 541 receive machine screws such as 542 having head portions 543, 545'. These screws hold metal spring steel plates 544 and 545 in position.

The ends of these plates engage within grooves 526', 527'.

As the ball moves from right to left and back again, the plates slide out of the grooves and ride over the edges between the faces when the follower 350 moves in a counter-clockwise direction. Pawl 523 does not move. When the follower moves in the opposite direction, i.e., when the bolt assembly 600 moves rearwardly after firing, the ends of plates 544, 545 engage in the back faces of the grooves, such as 526", and rotates the pawl.

Since the end of pawl 523 is engaged with hexagonal aperture 321 of rotary member 520, each time the bolt assembly retracts, a cartridge is advanced by assembly 300.

To insure that follower 350 stays in either the right or left position at the end of the forward or rearward travel, a series of three detents are provided on 530. In the right position, detents 536 and 537 are engaged by the biased projections such as 502' of members 501' and 501".

Flanges depending from receiver 101 engage along the side notches such as 529 on frame 501. The rearmost portion of top 509 of frame 501 rests atop trigger assembly 700. As shown in FIG. 5, a spring 731 extends from a bore 730 in assembly 700 and biases pawl 523 forward.

BOLT ASSEMBLY

The bolt assembly, generally designated as 600 in FIGS. 3, 5, 31–44, 48–50 and 54 is a floating type of bolt.

Figure 32:
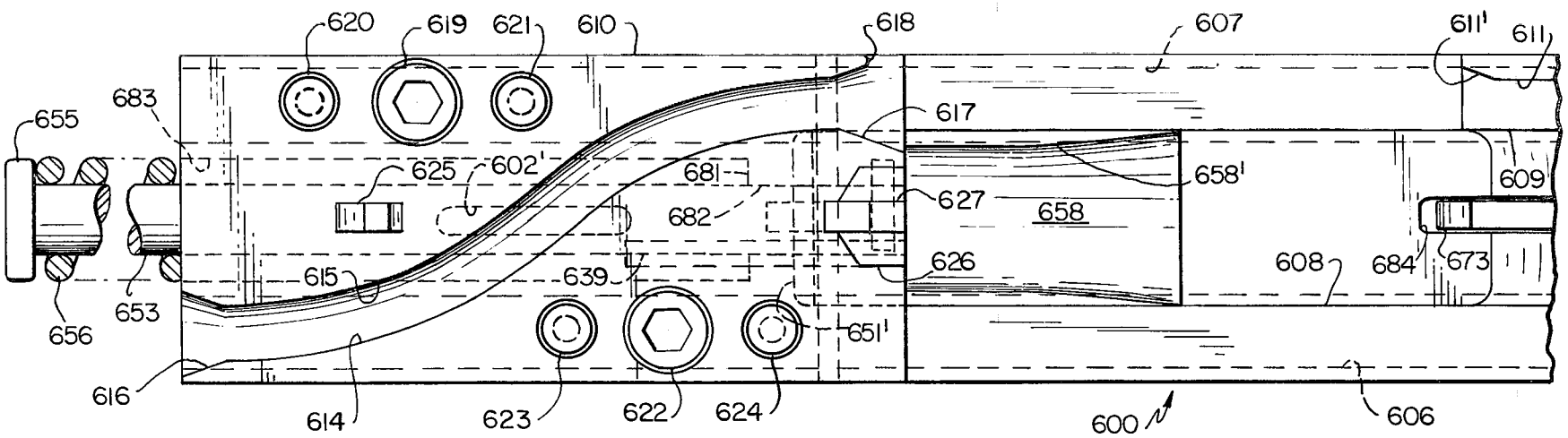
FIG. 32 is a botton view of the machine gun bolt.
Figure 31:
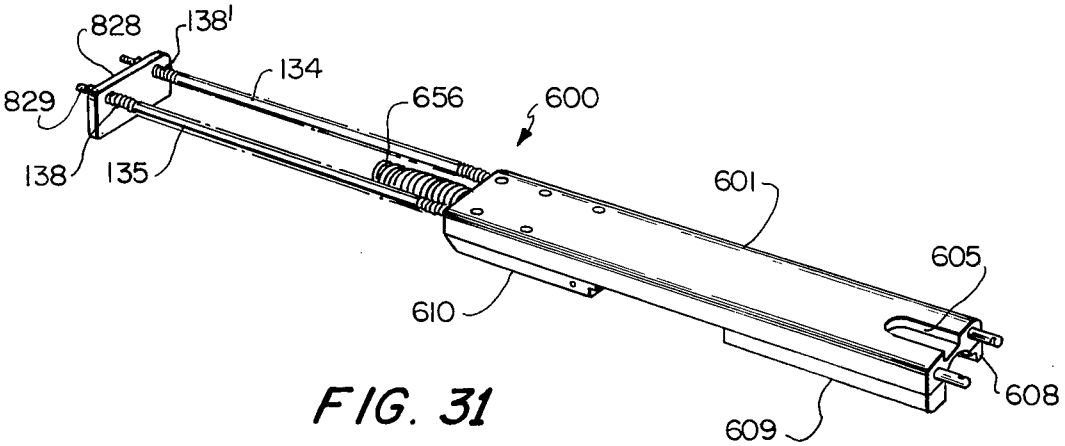
FIG. 31 is a perspective view of the bolt, buffering springs and buffering plate.
Figure 33:
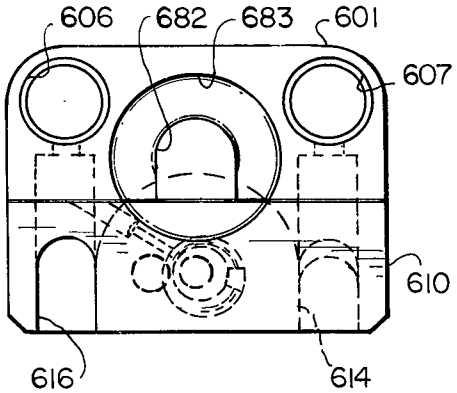
FIG. 33 is a rear view of the bolt.
Figure 37:
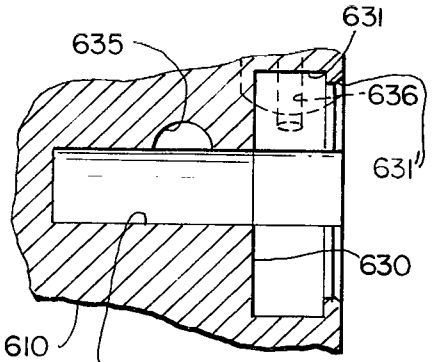
FIG. 37 is a partial sectional view of the lower bolt taken along lines 37—37 of FIG. 36.

Referring to FIGS. 31–33 the bolt is shown as having an upper bolt portion 601, a lower bolt portion 610 and guide portions 608 and 609. In the top of upper portion 601 is found a channel 605 which is adapted to receive the rear end of charging member 132 (see FIG. 6) i.e., when the user wishes to charge or cock the weapon, he pulls back on sight 102 which slides backward in receiver slot 128 (FIG. 13) and charger member 132 engages within channel 605 to force the bolt assembly rearwards along guide rods 134 and 135 until the projection 625 engages sear 705 (see FIG. 5) to thereby cock the gun. Actually, the bolt assembly slides rearwardly on guide springs 138 and 138' as shown in FIG. 5. The springs 138 and 138' are positioned in holes 606 and 607 in upper bolt portion 601 surrounding rods 134 and 135. Shoulders 606' and 607' (FIGS. 5 and 33) prevent the springs from passing completely through bolt portion 601. When the bolt assembly is moved rearwardly the springs 138 and 138' are compressed between shoulders 606' and 607 and plate 828. They stay in this compressed state until trigger 701 is pulled releasing the bolt.

Upper portion 601 also has a large bore 683 which terminates at shoulder 681 (FIG. 32). A buffer guide rod 653 passes through this bore and through rounded groove 682. Groove 682 is in communication with recess 617' in portion 601. Rod 653 is surrounded by buffer spring 656 and is threaded at one as at 654 (FIG. 48). Nut 655 secures buffer spring, a large and more rigid spring than guide springs 138 and 138', to rod 653.

Figure 39:
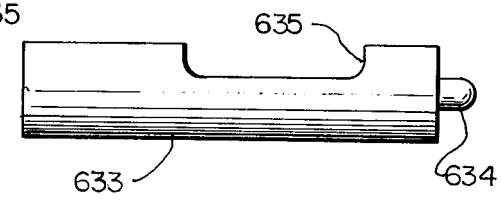
FIG. 39 is a side view of the member used as both the firing and ejection pins.
Figure 36:
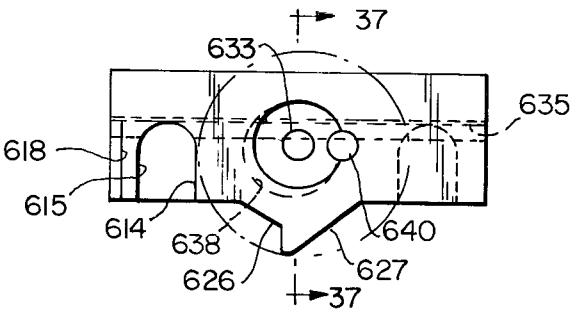
FIG. 36 is a front view of the lower bolt.
Figure 38:
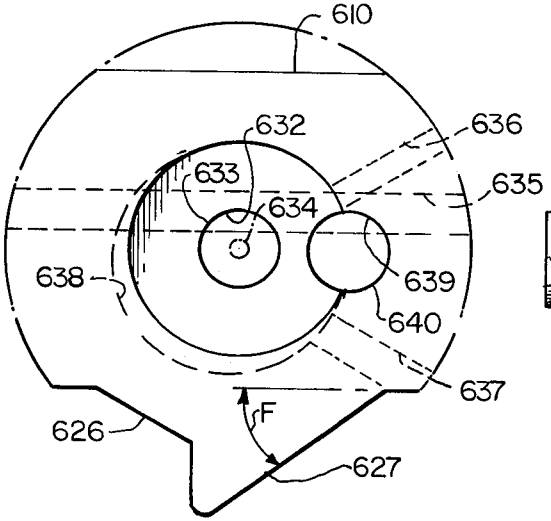
FIG. 38 is an enlarged partial view of the front end of the bolt.
Figure 34:
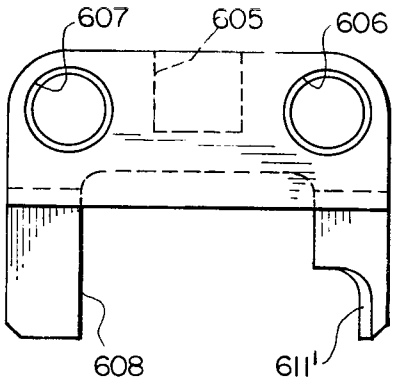
FIG. 34 is a front view of the upper bolt.
Figure 35:
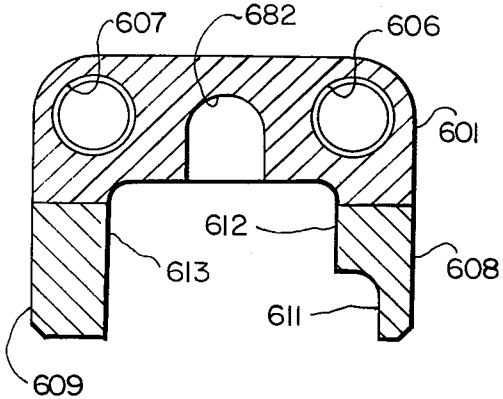
FIG. 35 is a sectional view of the upper bolt.

At the other end of rod 653 and integral therewith is buffer guide 651. The assembly of buffer guide 651, rod 653 and spring 656 is denoted as the buffer guide assembly and designated 650. Portion 657 of guide 651 is adapted to enter recess 617' in bolt portion 601. Guide 651 has a rubber end portion which acts as a bumper in impacting the rear wall of recess 617'. Guide 651 has a pad portion 660 which has a centering pad surface 658 thereon. The surface 658 is arcuate and the center of the arc radius is the center of firing pin 634 (FIGS. 38 and 39).

The underside of guide 651 is channeled as at 661 (FIG. 50) to provide groove 662 and has a pin 659 intersecting said channel. The purpose of the guide 651 and pin 659 will be described below.

Mounted to upper bolt portion 601 by bolts 619 and 622 and rivets 620, 621, 623 and 624 is lower bolt portion 610. The lower bolt portion 610 incorporates a linear cam 614 on its lower surface. Cam 614, shown in FIGS. 32–34, 36 and 54 has smooth inner walls such as 615 rounded ends as at 618 and beveled entrances as at 616, 617. Cam follower knob 531 of feed advance assembly 500 which has already been described.

The upper surface of lower bolt portion 610 is planar and is in surface engagement with the lower surface of upper bolt portion 601.

On the underside of lower bolt portion 610 has two projections thereon, namely cocking projection 625 (FIGS. 5 and 32) and cartridge chambering projection, 627 (FIGS. 5, 32, 36 and 38). The latter has a supportive section 626 and is angled out at angle "F" (FIG. 38) which is approximately 30°.

Projection 625 is engaged by the sear 705 (FIG. 5) until trigger 701 is pulled. The sear, moving downwardly, then releases the bolt allowing it to move forward and the firing sequence commences. As long as the trigger is held down, the gun maintains its automatic fire.

As the bolt moves forward, projection 627 engages the rear of cartridge 1001 (See FIG. 5) and moves it out of the area denoted by 309 and 310 of feed assembly 300. As the bolt continues to move forwardly, the cartridge is slid upward over cartridge ramp grooves 188 and 187 to align it with the opening of chamber 213.

As the cartridge commences to enter chamber 213 the buffer guide pad 660 and its surface 658 come into play.

Prior to describing the function of the pad 660 the firing and ejection structure should be described. Reference is had to FIGS. 40–44 and 36–39. FIGS. 40–44 show the action end of lower bolt portion 610. A recess 631 in the bolt face receives the end of the cartridge. The end of cartridge 1001 consists of leveled portion 1002, neck 1003, rim 1004 and rear face 1005 (FIG. 16).

Within recess 631 is an aperture 633 which receives firing pin 633. Firing pin 633 has a notch 635 (FIG. 39) therein and a firing projection 634. A smaller recess 631' opens into recess 631 and eventually bore 639 (FIG. 38) which contains ejector pin 640. Ejector pin 640 is identical in size and configuration to firing pin 633 but is reversed. Pins 633 and 640 are held in place (not shown) passing through bare 635 (FIG. 38). Firing pin 633 is fixed in position in bare 632 while ejector pin 640 is able to move with relation to the bolt. Pin 640 is fixed to the inner end of recess or bore 639 by a spring (not shown). Thus when bolt 600 commences to move rearwadly the pin 640 is slightly delayed and thus moves out into recess 631'.

Recess 631 has an arcuate notch 368 (FIG. 38) which receives an extractor member 638 of spring steel which has ends (not shown) extending through holes 636 and 637.

Figure 41:
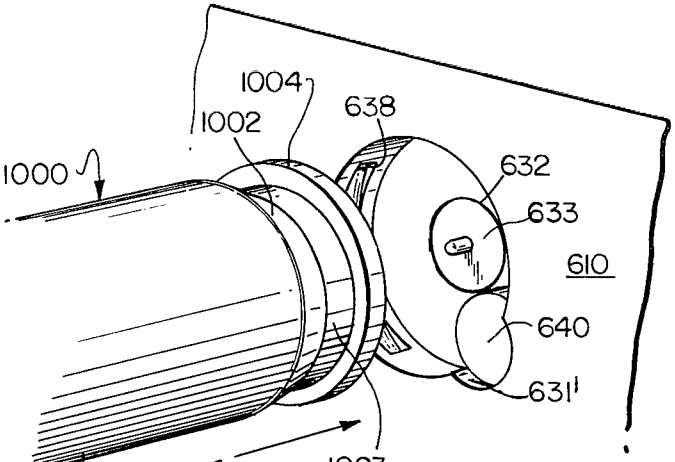
FIGS. 41 through 44 illustrate a firing sequence in which the bolt engages the cartridge, fires it and ejects it.
Figure 40:
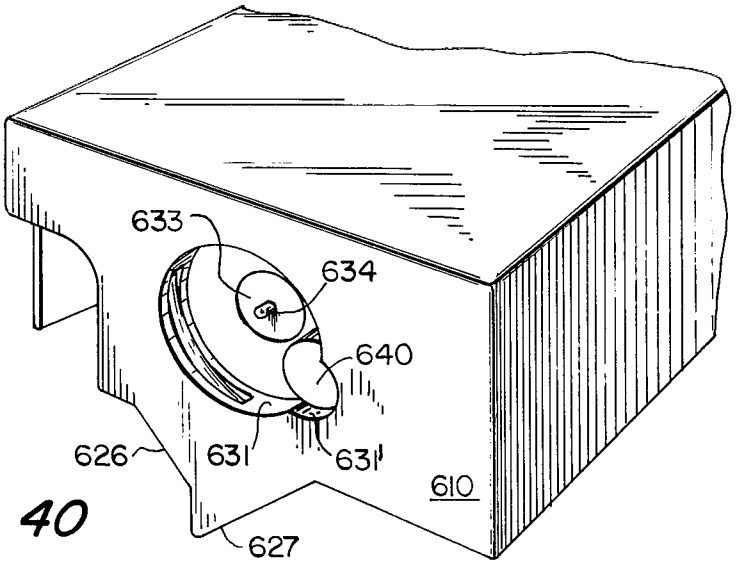
FIG. 40 is a partial perspective view of the firing end of the lower bolt.
Figure 44:
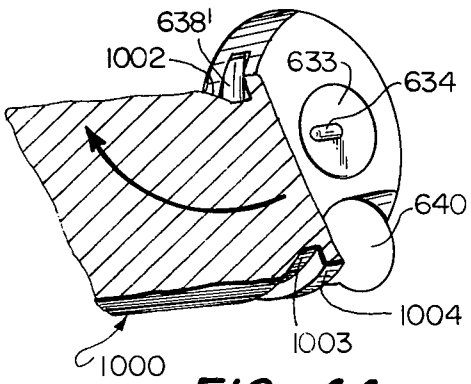
Figure 43:
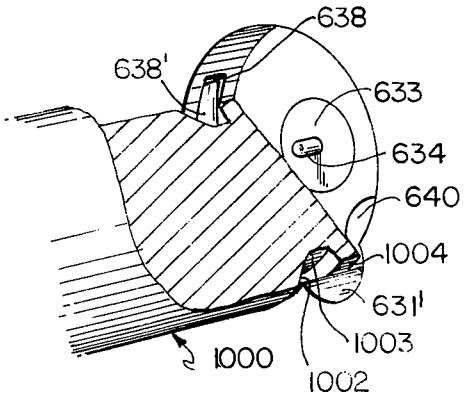
Figure 42:
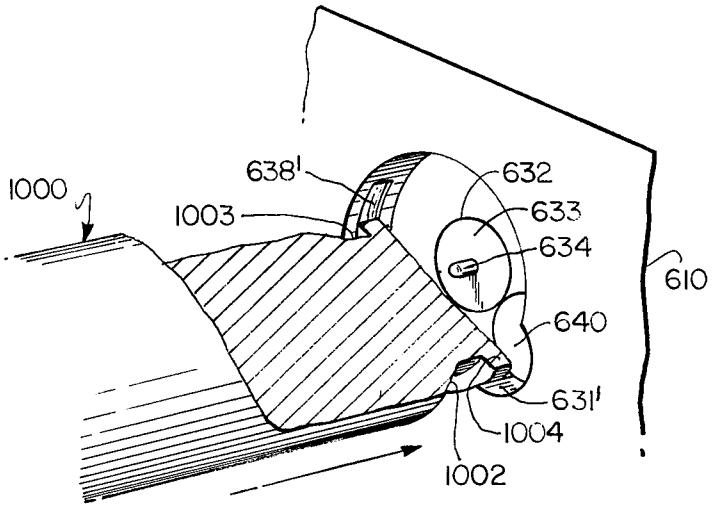

As the bolt moves forward and the cartridge face 1005 nears the front of the bolt appears as in FIG. 41. FIG. 42 shows the relative positions as the cartridge face 1005 enters recess 631 and rim 1004 depresses extractor 638' and nudges ejector pin 640. FIG. 43 shows the cartridge completely seated and the projection 634 has pierced cartridge face 1005 and firing occurs. FIG. 44 shows the action as the bolt is driven rearwardly. Pin 640 acts to push on one side of rim 1004 and tilt the cartridge since the other side is temporarily held by extractor 638'. The tilting continues as the bolt moves further rearward and the cartridge casing is ejected through ejection port 106 (FIGS. 1 and 2) and the next cartridge is advanced by assemble 300 to be in position for the next forward movement of the gun.

As previously stated, the face of lower bolt portion 610 is recessed to center the firing pin 633 extractor 638' and ejector 640 onto the cartridge head. The barrel is chambered and contains all of the cartridge head except for that amount shown in FIG. 16. The cartridge head must enter the bolt face recess. The last small amount of bolt travel has to be controlled to insure centering due to the amount of cartridge extending from the barrel assembly 200. If the cartridge extends rearwardly 0.10 of an inch the last one-half inch of bolt travel must be controlled to eliminate "wiggle", i.e., it should be damped out. Assuming that the chamber is centered relative to the barrel the instant weapon centers the bolt on the outside of the barrel. The chamber will then center with a point within the bolt. The point is the center of the lower bolt face recess 631, i.e., the center of pin projection 634. To accomplish this pad 660 is slidably mounted within the bolt assembly 600 just forward of the lower bolt face. The pad surface 658 is a surface circumscribed by an arc whose radius is the center of the barrel chamber. The pad length is approximately one inch, ½ inch for close centering and ½ inch lead-in. By actually guiding only the last one-half inch, the bolt is free to move by sand or other particles entrapped within the receiver and then locks in for the last one-half inch. This smooths out the transition from loose to tight bolt travel.

Since the pad wraps over the barrel there are forces necessary to maintain it in place on the barrel. The spacer can be made of plastic or brass. The spacer is located so that it bears for only the last one-half inch of bolt travel.

The bolt assembly 600 then can travel loosely throughout most of its travel and is only accurately controlled during a small part thereof.

Figure 49:
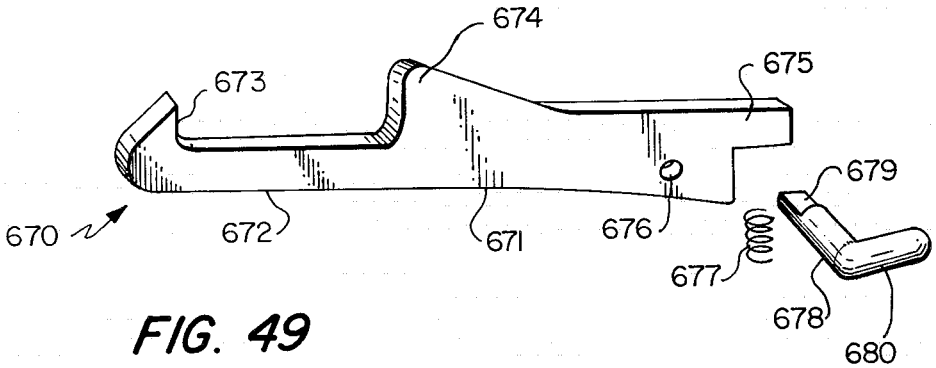
FIG. 49 is a perspective view of the sear.

The instant weapon can be operated at two rates of fire. Pad 660 is one half of a two component system that accomplishes this feat. Pin 659 of buffer guide assembly 650 acts as a sear shoulder. Sear assembly 670 is shown in FIG. 49. It comprises an elongated member 671 having cam 674, extension 672, sear hook 673, hole 676 and biasing projection 675. Spring 677 acts against 671 to pivot 671 clockwise. A rate control latch 678 is used to control rate of fire. By turning latch handle 680 the flat surface 679 will be either parallel to or perpendicular to the underside of projection 675. Sear assembly 670 is mounted in bolt portion 609 and member 671 moves within a slot 684 (See FIG. 54). As the bolt assembly 600 rides over the barrel, the barrel strikes the cam 674. Further movement of the bolt cam sear 673 by barrel 201 projection 673 engaging it. When the sear is cammed down the buffer guide assembly 650 is free to extend itself. However, since the bolt counter recoil has moved the buffer pad 660 beyond the extended reach of the buffer while extended, the extending force of the buffer spring 656 is lost or thrown into bolt assembly 600. To soften the impact the plastic bumper 651' (FIG. 32) is employed. Spring 677 is located in groove 684 to position the sear 673 upwardly. By camming the sear 673 down, i.e., by removing the bolt and turning latch handle 680 so that surface 679 is perpendicular to the underside of projection 675, the sear 673 will not catch pin 659 and the buffer buide assembly 650.

Therefore, if sear 673 engages assembly 650 a low firing rate results and if it doesn't, one gets a high rate of fire.

TRIGGER ASSEMBLY

Figure 45:
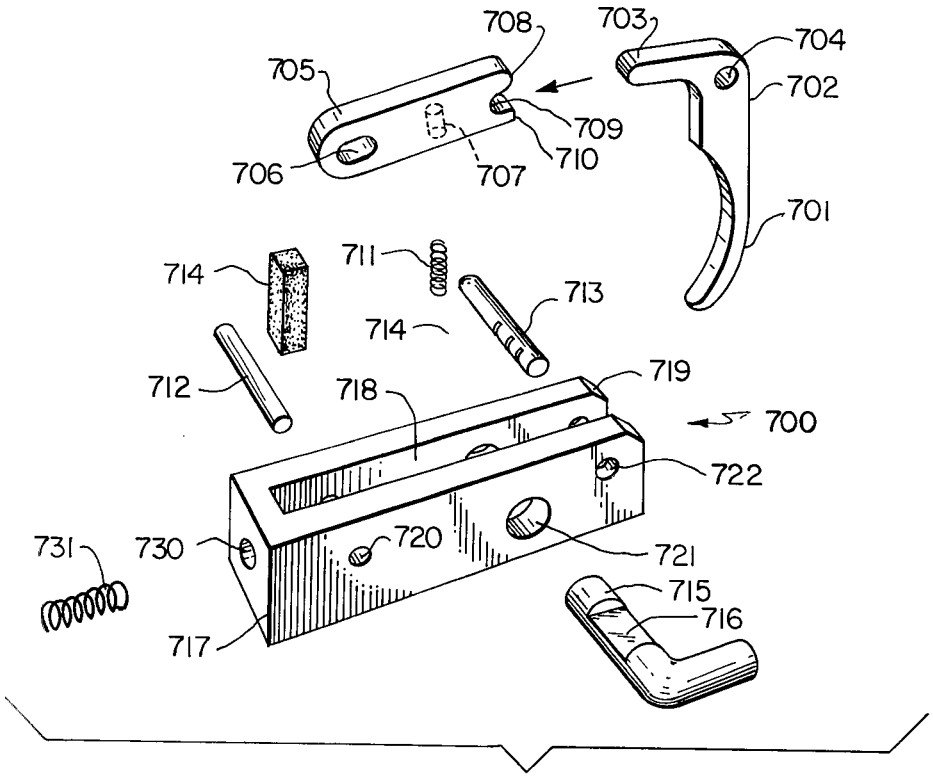
FIG. 45 is an exploded view of the trigger assembly.

The trigger assembly 700 is shown in FIGS. 5 and 45. It comprises a trigger 701 having main portion 702 with aperture 704 therein and extension portion 703. Portion 703 is adapted to engage within notch 709 of member 705. The ends of member 705 are rounded as at 708, 710 to allow the rounded end of portion 703 to ride easily therein. An elongated hole 706 is located in the opposite end of member 705 which allows member 705 to slidingly pivot on pin 712. A spring 711 engaging in a hole (not shown) in trigger housing 717 and in aperture 707 of member 705 biases the latter upward.

Housing 717 has an aperture 730 in one end thereof which receives spring 731. Spring 731 acts against the end 525 of lug 523 to maintain the lug biased to advancement mechanism 300. Apertures such as 720 receive 712 to maintain member 705 in place. A safety latch 715, having cut-away area 716 thereon is received within apertures such as 721. Area 716 allows the member 705 to pivot when it is in the position shown in FIG. 5. When latch 715 is rotated to its safety position, the rounded portion opposite area 716 prevents the member 705 from pivoting downward, as in FIG. 5, to allow the bolt assembly to move forwardly to fire the weapon. Pin 713 is received with apertures such as 722 and aperture 704 in trigger portion 702.

ALTERNATE FIRING MECHANISMS

Figure 53:
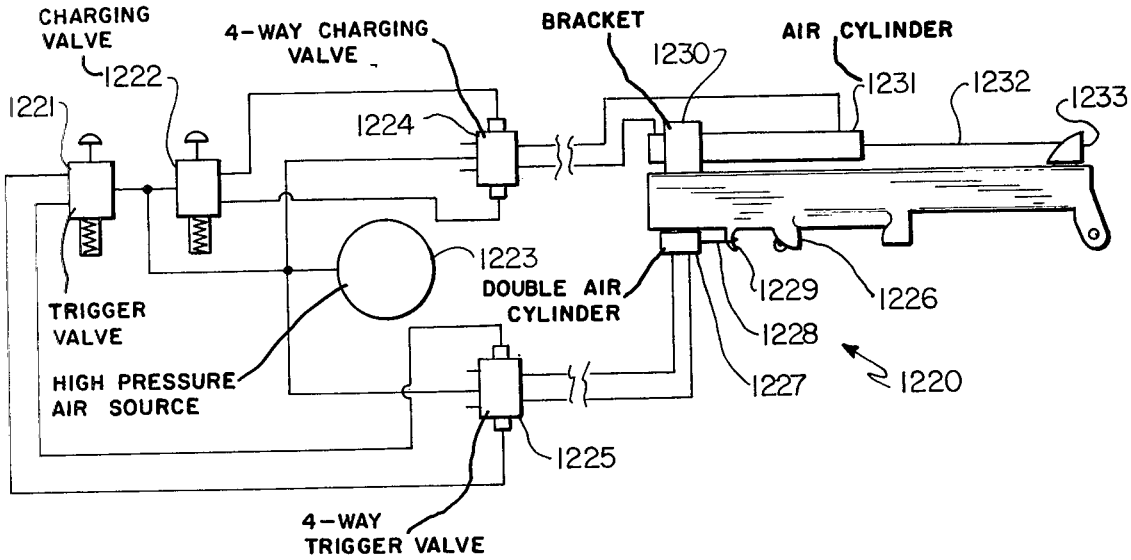
FIG. 53 is a schematic of an alternate remote control firing system with a charging capability.

In FIGS. 51–53 there are shown several alternate firing mechanisms that can be employed with the instant automatic weapon. FIG. 51 shows a remote control firing apparatus 1200. It consists of power source 1201, remote switch 1202, solenoid 1203 and a pin and spring unit 1204 which acts to normally force trigger 1204 forward. When switch 1202 is closed, solenoid 1203 acts against spring unit 1204 to pull the trigger rearwardly to fire the weapon. As 1205 is rotated rearwardly, it acts against spring 1208 to pivot member 1206 downwardly about pin 1207 thus allowing the bolt assembly to go forward and fire the weapon.

FIG. 52 shows an advanced pneumatic version of the mechanism of FIG. 51. It consists of a three way manual firing valve 1211 having a spring return 1212. A high pressure air supply 1213 is provided as well as check valve 214, a four way double air cylinder valve 1215, a two way air cylinder 1216 and a piston extension 1217 to engage the trigger. This system can detect remote loading and is self charging.

FIG. 53 shows a more elaborate pneumatic system generally designated as 1220. It has a charging valve 1222, a trigger valve 1221, a four-way double air charging valve 1224, a high pressure air source 1223 and a four-way double air trigger valve 1225. This much of the system can be located remotely from the weapon, designated as 1226, a bracket 1230 holding a double charging air cylinder 1231 on top thereof having a rod 1232 connecting it to slider charger 1233. A double air cylinder 1227 is attached to the base of the weapon and has a connection 1228 with trigger 1229. The cylinder 1231 is a long stroke variety and is capable of charging the gun when charging valve 1222 is activated.

Thus, any of the three remote control filing or charging systems described can be put on the instant automatic weapon.

STOCK ASSEMBLY

Figures 46, 47:
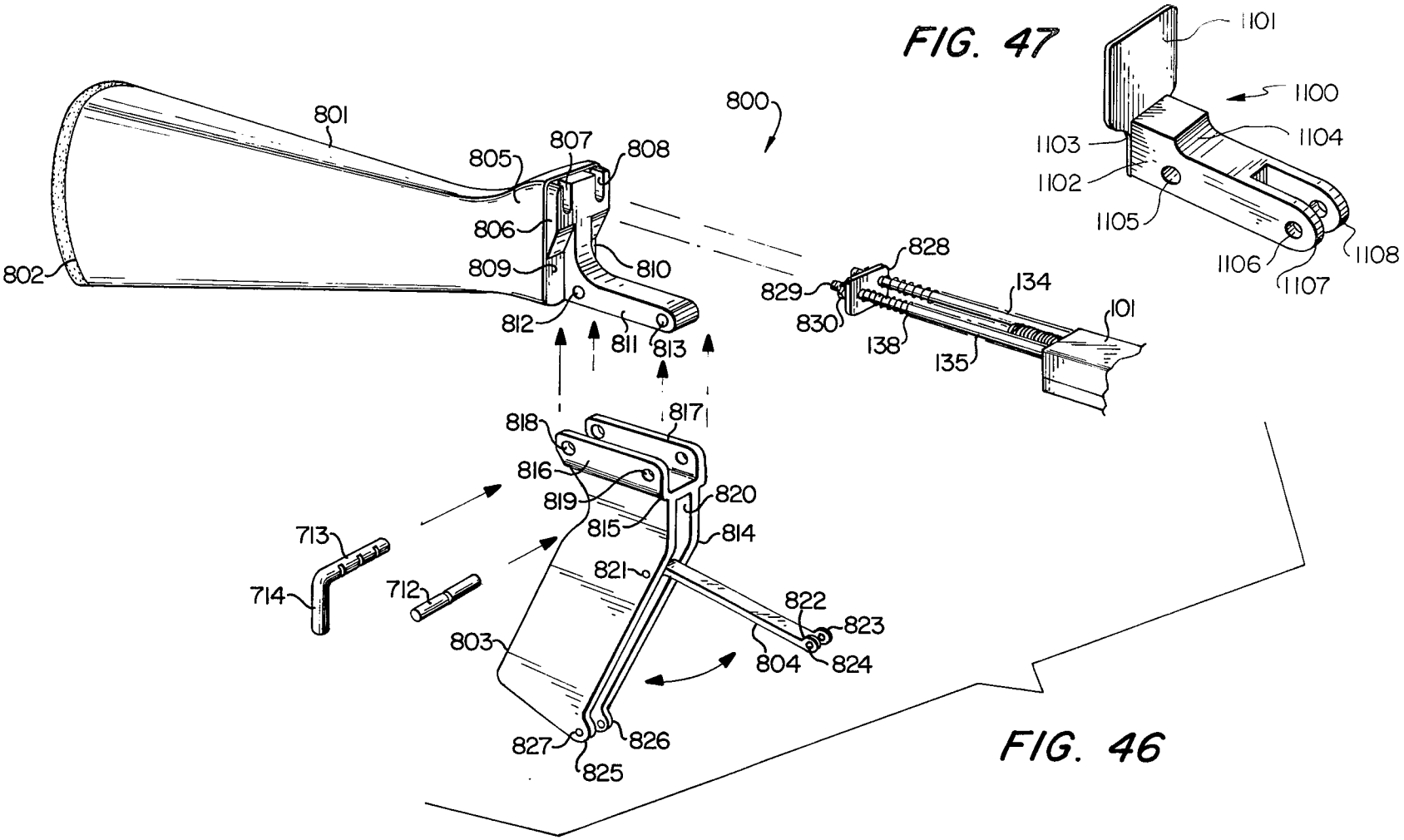
FIG. 46 is an exploded view of the stock assembly.
FIG. 47 is a perspective view of an alternate stock mount.
Figure 50:
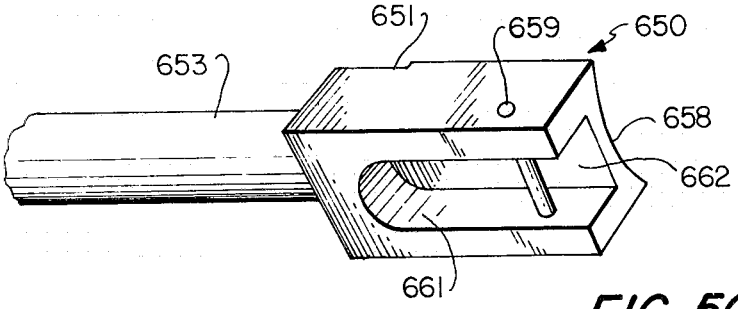
FIG. 50 is a partial perspective view of the buffer guide.

Referring now to FIGS. 3, 4, 46 and 47 there is shown the stock assembly generally designated as 800 in FIG. 46 and an alternate assembly as 1100 in FIG. 47. The stock 807 consists of a balsa wood core 851 covered with a thermoplastic covering 850. This provides for a lightweight stock which has a recoil pad 802 on the base thereof. The attachment portion of the stock has a thickened portion 805 having faces 809, 810 with raised portion 806. Raised portion 806 has a pair of notches 807, 808 therein to receive the ends 829 of guide rods 134 and 135. Nuts 830 secure the threaded ends to butt plate 828 although the rods 134, 135 may be welded directly to plate 828. An L-shaped extension 811 of the portion 806 has a pair of bores 812, 813 therein. Referring to FIG. 4, it is seen that a pair of spring-ball plunger units 812', 813' are located within a longitudinal bore within 811. Balls 812", 813" protrude into bores 812, 83, respectively to securely lock notched pins 712, 713 therein. Pin 713 has an angled handled portion 714 thereon. A handle 803 is adapted to be secured to the end of the receiver and to portion 811 of the stock assembly by pins 712 and 713. Handle 803 has a hollow inner portion 803' and has a pair of flange portions 816, 817 extending upward from widened areas such as 815. Flanges 816 and 817 have holes such as 818 and 819 therein and engage either side of portion 811. The necked down portions 153 and 154 of receiver assembly 100 (FIG. 3) engage on either side of flanges 816 and 817. As shown in FIG. 3, receiver portions 153 and 154 have holes therein. The holes near the end of receiver portions 153, 154 are opened to the edges thereof so that when pin 713 is removed the stock assembly may be swung downwardly, pivoting on pin 712. The assembly 800 swings down sufficiently so that access may be had to the components in the rear of the receiver. In fact, the whole bolt assembly 600 including guide rods 134 and 135 may be removed from the receiver without any further disassembly thereof.

Handle 803 is notched as at 820 in the front thereof and has a pair of tab portions 825, 826 at the base thereof. A pin 821 pivotally secures a retractable trigger guard 804 to handle 803. At the end of guard 804 are a pair of tab portions 822, 823 having ball projections such as 824 thereon. These projections are adapted to snap into holes such as 827 in tab portions 825 and 826. Since the handle and guard 804 are made of plastic the guard can be easily snapped into recess or notch 820.

FIG. 47 shows an alternate stock 1100 that is used when firing the weapon from the prone position. It consists of a metal or plastic butt plate 1101 which is attached, at its narrowed portion 1103 to member 1102. Member 1102 is essentially of the same shape as portion 811 inasmuch as it slopes down at 1104 and has a pair of bores 1105 and 1106 therein. The end thereof is split to provide tabs 1107 and 1108.

OPERATION

Charge the action by pulling back on front sight 102 or 1350 to the rear until bolt assembly 600 strikes the buffer plate 828. Afte charging, return sight 102 to the forward position. Sight 1350 will latch in place automatically while 102 will be kept in place by friction.

To load the weapon depress the feed release lever 518 located forward of the feed ratchet housing with the forefinger of the right hand. With the left hand, insert the feed assembly 300 into the left side of the receiver 101 until the feed cover 301 strikes the right receiver wall. Release the feed cover release lever. It will move forward and lock the ratchet mechanism 500 within the gun to the feed cover. The weapon is now loaded.

If by chance the feed assembly 300 had not been loaded with a cartridge belt prior to the field loading, the following sequence describes the loading of the belt into the feed cover 301. With the right hand, grasp the feed cover 301 so its under side is upward. Insert the open link end of the ammunition belt into the slot on the bottom of the feed cover. With the thumb, continue to force the belt into the feed cover. Three clicks will be heard or felt. The sprocket 320 within the feed cover has rotated the first three rounds and locked them into place. Turn the feed cover over and check the cartridge alignment in the feed slot. Return the feed cover to the ammunition box 400 and replace the feed box handles 401 and 402. It is intended that the feed cover be loaded prior to weapon fielding in order to minimize the time required to load the weapon in the field. When the feed box is depleted of its two hundred plus round allotment, the feed cover is intended to be retained by the gunner and reused on future ammunition boxes. The ammunition box 400 itself is intended to be an expendable item but capable of being reused.

To fire the weapon rotate the safety 715, located on the lower right hand side of the receiver forward of the trigger 701, to the forward "fire" position. Rotating the safety unlocks the sear 705 and trigger 701. By depressing the trigger, the gun will now fire. The gun is fully automatic and will continue to fire as long as the trigger is depressed.

If a misfire occurs, release the trigger and pull the front sight 102 to the rear until the bolt strikes the buffer plate. Return the front sight and allow it to latch into place. The gun has now been cleared of the misfire, the feed system 300 advanced, and a fresh cartridge indexed in the feed way.

The cartridge line "C" is contained within the top feed cover until the cartridge is chambered. Once the bolt has chambered, the link is free to move to the right and clear of the gun. If gravity or some other force pulls the link, it could clear the gun as soon as the cartridge has been stripped from the link. Under normal conditions the cartridge link will eject from the gun during feed advance. The velocity given the link during ejection is equal to the feed belt advance. The ejection path is straight to the right hand approximately parallel to the cartridge case ejection. The link ejection path and the sequence of when link ejection occurs, assures that the cartridge case and the ejected link will not interfere with each other during their ejection.

To change the gun barrel 201, the left hand holding the forearm is moved forward so the index finger and thumb can depress the barrel pawl levers. Once the levers have been squeezed together, the forearm is pulled downward away from the receiver. The barrel will pivot around pins 193, 194 located on the feed ramp 178 and "break opin" like a shotgun. Once the barrel has been broken from the receiver, it is pulled forward off the pins and clear of the gun.

To replace the barrel, the sequence is reversed. First, the base of the barrel is inserted over the pivot pins 193, 194 and then pivoted upward into the receiver. Once correct index is obtained the spring loaded barrel pawls engage the locking shoulders of lug 217 on the barrel to lock the barrel in place. The barrel can be changed with the bolt in either the forward or the rear position.

The gun is equipped with a muzzle brake 202 that moves the muzzle of the barrel downward during firing. This is accomplished by venting muzzle gases upward and to the rear after the bullet has left the muzzle. The muzzle brake gives the entire weapon a forward and downward movement and counters the later rear and upward movement incurred during gun recoil. During a burst, the gun rocks forward and aft, and thus increases the control of the weapon by preventing muzzle climb and weapon setback.

When the trigger 701 is depressed it cams the sear 705 down, thus permitting the bolt 600 to move forward under the impedance of the recoil springs 138. Forward movement of the bolt 600 strips the cartridge from the cartridge link. Once the cartridge is free of the link, the feed ramp 178 cams the cartridge nose upward into alignment with the gun chamber 213. Continued movement of the bolt raises the head of the cartridge into chamber alignment for final chambering. During final chambering the ejector 640 will push the cartridge into the chamber until the cartridge shoulder 1006 strikes the chamber shoulder 214, at which time the cartridge head overcomes the preload of the cartridge ejector 640 and starts to depress the ejector. The buffer guide pad surface 658 is in engagement with the top of barrel 201.

The action of depressing the cartridge ejector moves the bolt (relatively) over the cartridge head and thus allows the fixed firing pin to strike the cartridge primer. During this relative bolt movement period, the cartridge extractor 638' is cammed over and into the rim 1004 of the cartridge head. After the firing pin projection 634 contacts the primer, the cartridge propellant is ignited and its rapid burning expands the cartridge case to the wall of the chamber. While the case body 1001 is expanding to the chamber wall, the cartridge head 1005 is moving toward the rear accelerating the bolt to the rear. Once the cartridge case meets the chamber wall 213, obturation occurs and the case body locks to the chamber walls for the high pressure period. During this period of time, the cartridge head 1005 is still moving to the rear accelerating the bolt and also elongating the cartridge cases 1001. Since the cartridge case is being elongated, bolt acceleration is lower than a standard blow back.

Once the high pressure period is over, the case 1001 is freed from the chamber walls and moves with the bolt 600 to the rear of the mechanism. The bolt and case movement toward the rear continues until the mouth of the case clears the chamber face, at which time the cartridge ejector 640 can move forward and pivot the case around the cartridge extractor. This pivoting movement throws the cartridge case through the ejection slot and clear of the gun.

After the cartridge case has been ejected, the bolt cams the feed ratchet assembly 500 and indexes a fresh round within the feed assembly 300. Final movement of the cartridge within the feed cover 301 is downward into a cartridge tray such as 329 machined into the feed sprocket 320. The cartridge link drops down between the tray and the rear of the sprocket onto a link ejection guide 337. Two cartridge depressors 335 and 336 retain cartridge location. Once the cartridge is under the cartridge depressors, any forward movement of the cartridge will strip the cartridge from the cartridge link. When feed index is complete, the bolt cam 614 stops the feed ratchet and locks it in place. Once the feed ratchet is locked, further bolt movement is restrained by the buffer plate 828.

Throughout the entire recoil cycle, the recoil springs located within the bolt have been compressed; but after the buffer plate of the guide rods is impacted by the buffer spring 656 it can compress into the bolt two inches. Actual buffer stroke depends upon the bolt recoil energy at the time of buffer plate impact. The buffer plate 828 transmits all recoil forces, (recoil springs; buffer; and if the buffer bottoms out, the impact of the bolt against the buffer plate) to the bolt guide rods 134 and 135. If the buffer spring 656 bottoms out, the buffer plate will pull the guide rods to the rear. The guide rods are secured to the front bulkhead 139 of the receiver, so any movement to the rear of the buffer plate will stretch the guide rods and transmit the load to the bulkhead. The forward bulkhead then transmits the load to the entire gun mass, thus damping the original recoil force given to the bolt at the time of firing.

When bolt recoil is stopped, the recoil springs push the bolt 600 forward into counter recoil. The bolt will move forward until it reaches the seared position. If the sear 705 is still depressed, the bolt will continue forward beyond this point and being another cycle. If the sear has been released by the trigger, the bolt projection 625 will impact the sear 705 and move the sear forward into the sear buffer 714, and the gun cycle stops. This concludes the sequence of operation of the basic mechanism.

To field strip the weapon, first charge the weapon and check the chamber to assure that the gun is unloaded. After the bolt has been seared, depress the feed cover release lever 518 and remove the feed cover 301 to the left of the weapon. Depress the trigger 701 and allow the bolt 600 to go forward. Remove the barrel 201 from the weapon. Rotate the receiver end cap latch 713 so that the arm 714 points downward. This will allow the stock assembly 800 to pivot downward, opening the rear of the receiver 101. Rotate the guide rod retaining latch 153 and remove the guide rod assembly through the rear of the receiver. The bolt can now be removed from the rear of the receiver. The gun is now field stripped. See FIG. 3.

If further weapon take down is necessary, the following sequence will strip the weapon to its major component or fixed assemblies.

To remove the fire control housing from the receiver, rotate the safety 715 to the down position. Pull the safety 715 to the right and clear of the receiver. Remove the fire control housing 717 from the receiver by pivoting it downward and away from the ratchet housing support shoulders 509. Using a cartridge point, push out the two pins. In the fire control housing: one pin 713 for the trigger, another pin 712 for the sear. The trigger 702 and sear 705 can now be removed from the fire control housing. Removal of the sear 705 will also remove the fire control spring 711.

To disassemble the feed ratchet assembly use a cartridge point to remove the feed assembly release lever pivot 517. Remove the feed cover release lever 518 from the ratchet housing 501. Once the feed cover release lever is removed, the feed ratchet can be removed through the front of the ratchet housing. Remove the feed ratchet arm by inserting a cartridge point through the position previously occupied by the feed cover release lever.

To disassemble the butt stock 801 from the pistol grip use a cartridge point to remove the pivot pin 712 holding the stock's assembly to the receiver. To separate the two parts use a cartridge point and remove the receiver end cap latching lever 713.

Using a cartridge point, remove the bipod leg pivot pin 108'. No further action is required.

To remove the feed ratchet housing from the receiver, remove the four allen head screws holding it to the receiver. To remove the two feed ratchet arm plunger units 501' and 501'' from the feed ratchet housing, insert a screwdriver into the rear of the two tapped holes and back them out. Do not attempt to remove the hardened steel bushing 506 within which the feed ratchet rotates.

To remove the feed ramp from the receiver, remove the four allen head screws holding it in place.

To remove the lower portion of the bolt from the bolt assembly, knock out the four retaining dowel pins 620, 621, 623 and 624 and then the two allen head screws 619 and 622. This will free the lower bolt 610 from the bolt assembly. To disassemble the lower bolt, drive out the ejector retaining pin. This will allow the ejector spring and plunger 640 to move forward free of the bolt. To remove the extractor, depress the extractor spring and lift the extractor off its pivot pin. This completes lower bolt disassembly. To remove the buffer system 650 from the upper bolt assembly, unthread nut 655 and pull pad 660 free of the bolt. Buffer spring will fall out.

This concludes component disassembly of the entire weapon. To remove further components from either the receiver or feed cover assembly would require the removal of rivets or welded assemblies.

Alternate Bulkhead

Refering to FIG. 55 there is shown an alternate bulkhead assembly 1300 which may be utilized. It consists of a bulkhead plate 1301 which can be made up of several layers of high tensile steel. Plate 1301 has a pair of guide rod holes such as 1302 therein, a latch pivot hole 1303 a locking lug 1304 for engaging notch 1369 on charging member 1350 (FIGS. 56 and 57) and a U-shaped barrel receiving notch 1305. The plate 1301 has an extension portion 1306 which terminates in attachment wings 1310–1312. Holes such as 1307, 1309 and 1314–1316 may be used to secure it to the front of the receiver. The whole assembly can also be welded to the receiver. It has holes such as 1308 for receiving screws on a tripod mount (FIG. 2).

A pair of support members 1318 and 1320 are welded to the inner sides of extension portion 1306 and as at 1321 have holes to align with holes such as 1317. These holes receive pins such as 1322 to pivotally secure barrel lug pawls, such as 1323 which secure the barrel in place as previously described.

A pair of bipod support tabs 1219 and 1325 extend from the front of plate 1301 and are welded thereto as at 1326. They have folded position notch 1328, arcuate portion 1327 and two-position notches 1329 and 1320 so that the bipod legs may be placed in either of two supporting positions. Relief holes such as 1333, 1334 and pivot pin cut-outs 1331, 1332 are provided.

Alternate Charging Assembly

Referring to FIGS. 56 and 57 there is shown an charging assembly 1350 which can be employed with the weapon. It consists of a base members 1351 and 1352 which can be made integral, if desired. They are cut away at the top to provide arming guides 1353 and 1354. A pair of aligned bores 1355, 1356 receive a cylindrical handle 1375 of lesser diameter therethrough. In the area or slot between members 1351 and 1352 is a latching member 1364. Its top 1366 is below guides 1353, 1354 to provide a center aiming member for the front sight. Member 1364 is angled as at 1367, arcs at 136 and has a notch 1369 which receives lug 1304 (FIG. 55). It has a cut away area 1370 and a spring receiving bore 1372. Membe 1364 is pivotally mounted on pin 1363 for pivotal movement. Its notch 1369 is biased down by the action of spring 1374 which has one end in bore 1372 and the other in bore 1371 in slide base 1360. Screw plug 1373 keeps spring 1374 in place in bore 1371.

Slide base 1360 is slotted as at 1358 and notched as at 1359. Since the top 1359 of the slide base 1360 is wide the edges of the receiver slot (not shown) fit in 1358 and allow base 1360 to slide on the receiver. Notch 1357 is to allow it to slide forward for enough when bulkhead assembly 1300 (FIG. 55) is being used, i.e., it enables it to clear tabs 1312 and 1313.

The front of 1360 has a bore 1361 therein which holds a resilient plug member 1362 to cushion the shock of 1360 hitting the inner portions of the bulkhead.

A pair of studs 1376, 1377 extend upwardly from the rear of the assembly and support a pin 1378 on which the central portion 1379 of a wire sling swivel 1380 is mounted. Swivel 1380 can be used with another swivel (not shown) mounted on the rear of the receiver or stock 801.

By pulling rearwardly on member 1375, latch 1364 rotates counterclockwise just sufficient to disengage notch 1369 from lug 1304. After the gun is cocked the assembly 1350 is pushed forward and automatically locks in place.

While only one embodiment of the instant invention has been shown and described, it will be obvious to those of ordinary skill in the art that many changes and modifications can be made without departing from the scope of the appended claims.

I claim:

1. An automatic weapon for automatically firing live cartridges comprising:

a. a receiver housing;
b. a bolt assembly slidably mounted for fore and aft movement within the housing;
c. trigger means for releasing the bolt assembly;
d. a barrel assembly including chamber means mounted in the housing;
e. a feed system;
f. the bolt assembly being adapted to advance the feed system while ejecting spent cartridges during its aft movement and to chamber live cartridges and reset the feed system, the bolt assembly comprising:
   1. a body having top and bottom surfaces; and
   2. a buffer assembly biasably movably mounted on the bolt assembly adatped tp seat on top of the barrel of the barrel assembly when the bolt assembly is moving forward to chamber a cartridge, the buffer assembly also acting to absorb excess energy to reduce peak recoil forces.

2. A weapon as in claim 1 wherein the bolt assembly also includes;

a. a lineal cam groove located on the bottom surface; and
b. a firing pin and extractor-ejector assembly located in front of and adjacent the cam.

3. A weapon as in claim 2, the feed system comprising:

i. a feed ratchet subassembly mounted within the housing adjacent the trigger means and having a cam follower for rotating the ratchet, and ii. a feed cover partially mounted in the housing and being slideably removable therefrom during loading and unloading the weapon with ammunition, the cover having a rotatable biased sprocket and holding means to permit the sprocket to rotate in only one direction when there is ammunition in the cover, the sprocket rotated by the ratchet.

4. A weapon as in claim 3 wherein the feed cover means includes a feed way, a plurality of feed grooves in the sprocket in which belted cartridges are adapted to lie, and spring means adapted to biasly engage the cartridge aligned in the feed way, the feed way adapted to position a cartridge for engagement by the bolt assembly.

5. A weapon as in claim 4 wherein the sprocket has a series of detents therein corresponding to the number of feed grooves, and the feed grooves, and the feed cover includes a spring biased plunger means adapted to engage the detents to lock the sprocket against rotative movement during the bolt fore movement.

6. A weapon as in claim 3 wherein said feed cover includes a pair of guide members thereon, the receiver housing having a pair of traverse slots therein, the guide members adapted to slide in the slot members to allow the feed cover to be slid sideways from the receiver.

7. A weapon as in claim 3 wherein said feed cover has an ejection part therein for allowing belt clips to be sequentially ejected as the bolt assembly advances cartridges into the chamber means.

8. A weapon as in claim 3 wherein the assembly contains a cam and the cam follower is adapted to ride therein.

9. A weapon as in claim 8 wherein the ratchet assembly includes pawl means, the pawl means being mounted for rotary and sliding movement, the cam follower as attached to the ratchet mounted for side to side traverse movement, the cam in the ratchet assembly being configured so as to effect a side to side movement of the ratchet as the bolt assembly advances and retracts.

10. A weapon as in claim 9 including a spring means and wherein pawl means is normally biased forward by the spring means to engage the sprocket within the feed cover.

11. A weapon as in claim 10 including a lever to retract the pawl means from engagement with the sprocket so that the feed cover means can be slidably detached from the weapon.

12. A weapon as in claim 9 wherein ratchet subassembly includes detent means and cooperating spring biased plunger means to arrest movement of the cam follower between its periods of side to side movement created by the cam.

13. A weapon as in claim 3 wherein the weapon also includes an ammunition box, the box being attached to the feed cover and comprising a housing, an opening in the top of the housing for allowing feed of belted ammunition to the weapon, and positionable carrying means on said housing and adapted to form a handle for said weapon.

14. A weapon as in claim 13 wherein said box is rectangular, in front and side views and the opening is located on the top of the housing.

15. A weapon as in claim 14 wherein the carrying means comprise a pair of juxtapositioned handles, the handles being pivotally mounted to the housing adjacent the opening, the handles adapted to be swung so as to lie flush with the sides of the housing in one position and adapted to be swung upwardly towards each other to form a carrying handle for the weapon.

16. A weapon as in claim 15 wherein the feed cover and the box housing have aligned holes therein, the handles having portions filling the holes and securing the box to the feed cover.

17. A weapon as in claim 13 wherein the box is constructed entirely of plastic.

18. A weapon as in claim 17 wherein a portion of the plastic box is transparent to enable a gunner to ascertain when the cartridge belt is almost expended.

19. A weapon as in claim 1 including means detachably mounting the barrel assembly to the receiver housing.

20. A weapon as in claim 19 wherein the detachable mounting means includes a notch means in the front of said housing and stud means about midway in the length of the housing, the barrel assembly having cooperating holes to receive the studs and lugs to secure the barrel to the housing.

21. A weapon as in claim 20 wherein the notch means includes a downward facing arcuate U-shaped notch in the housing, biased pawl means mounted on each side of the notch, the pawl means adapted to cooperate with the lugs to detachably secure the barrel to the receiver housing so that a gunner may, by pressing the pawl means, remove the barrel from the receiver housing.

22. A weapon as in claim 21 wherein the receiver housing has a front bulkhead member, the notch being in the bulkhead member, the pawl means comprising a pair of pawls pivotally mounted on the bulkhead member and spring means biasing the tops of the pawls to engage the lugs.

23. A weapon as in claim 22 wherein the lugs comprise two spaced lugs, the spacing between the lugs being slightly greater than the width of the bulkhead member and the lugs extending not more than 180° of the barrel assembly.

24. A weapon as in claim 23 wherein the ends of one lug are beveled to cooperate with the pawls to prevent rotation of the barrel.

25. A weapon as in claim 20 wherein the barrel assembly comprises a barrel and forearm grip means, the grip means forming the bottom of the receiver housing when the barrel assembly is attached to the weapon.

26. A weapon as in claim 25 wherein the grip means comprises a channel shaped member adjacent the bottom of the chamber portion of the barrel, a pair of flanges securing the member to the barrel, the rearmost flange having holes therein to receive the studs.

27. A weapon as in claim 20 including one barrel assembly which is constructed to accommodate one caliber cartridge and a second barrel assembly constructed to accommodate a second and different caliber cartridge both of which can be fired from the same weapon without changing other parts.

28. A weapon as in claim 22 wherein the receiver housing includes a front bulkhead member, the receiver channel being generally an inverted channel member and the bulkhead member fixedly secured to the receiver so as to close the front end of the channel member

29. A weapon as in claim 28 wherein said weapon includes a buffer plate, a pair of spaced parallel guide rods, the guide rods being secured at one end to the buffer plate, the bulkhead member having a pair of holes therein and a movable latch means secured thereto, the guide rods extending through the holes and being secured in place by the latch means.

30. A weapon as in claim 29 wherein said latch means comprises a latch member pivotally mounted to said bulkhead member and having portions overlying the holes when in a central position, the latch member being configured so as to uncover the holes when pivotally swung in either direction, the guide rods having slots in the ends thereof adapted to receive the latch member portions when the latch member is in the central position thereby locking the guide rods in place.

31. A weapon as in claim 28 wherein the bulkhead member has a pair of tab portions on each lower side thereof, a pair of swingable bipod legs, pivot means, each tab portion having the pivot means mounting the bipod legs thereon for swingable movement, the legs adapted to support the front end of the weapon in one of several positions and to be folded back along the receiver housing when not in use.

32. A weapon as in claim 3 which includes recoil absorbing means on the front end of the receiver of the receiver housing.

33. A weapon as in claim 32 including a recoil absorbing system, the system comprising recoil energy absorbing means, recoil transmitting bolt guide rod means, and recoil buffering means.

34. A weapon as in claim 33 wherein the recoil energy absorbing means comprises a strengthened bulkhead member secured to the front of the receiver assembly and adapted to receive all of the recoil forces, directly or indirectly.

35. A weapon as in claim 34 wherein the bolt guide rod means includes a pair of spaced guide rods secured at their front end to the bulkhead member and at their rear end to a portion of the recoil buffering means, the bolt assembly slidably mounted on the guide rod means.

36. A weapon as in claim 35 wherein the recoil transmitting bolt guide rod means also includes compression springs mounted on the guide rods between the rear ends thereof and the bolt assembly and adapted to absorb and energy of the bolt on its rearward movement, to slow it down and to assist in forcing it forward.

37. A weapon as in claim 36 wherein the guide rods are attached to a buffer plate member which is a part of the recoil buffering means, the buffer assembly adapted to impact upon the buffer plate, which in turn, transmits this force through the guide rods to the bulkhead member.

38. A weapon as in claim 1 wherein the bolt assembly includes an upper bolt portion and a lower bolt portion, the upper bolt portion having a pair of elongated parallel bores therein, the bores being counterbored for a greater part of their length, a pair of parallel guide rods, the guide rods being secured at one end thereof to the front of the receiver housing and at their other end to a buffer plate, the upper bolt portion bores receiving the guide rods and a compression spring mounted on each guide rod between the buffer plate and the juncture of the bores and their counterbored portions thereby tending to bias the bolt toward the forward end of the receiver.

39. A weapon as in claim 38 wherein the receiver housing has a longitudinally extending slot therein, a combination front gunsight-charging means mounted for sliding movement in the slot, whereby to cock the weapon the front gunsight is pulled rearwardly to engage the bolt assembly with the trigger means to overcome the biasing force of the guide rod compression springs.

40. A weapon as in claim 38 wherein the lower bolt portion has a first projection member on the base thereof, the projection member adapted to engage cartridges from the feed system and chamber them into the barrel assembly.

41. A weapon as in claim 40 wherein the lower bolt portion also includes a sear projection thereon, the trigger means including a biased sear means, the sear projection adapted to engage the sear means when the trigger means is not depressed.

42. A weapon as in claim 38 wherein the lower bolt portion includes a recess, the recess adapted to receiver the end of a cartridge casing therein, fixed firing pin means in the recess and adapted to fire the cartridge when it is fully chambered by the bolt assembly.

43. A weapon as in claim 42 including an extractor means in the recess, the extractor means being biased so as to engage one portion of the rim of a cartridge and to simultaneously extract it and tip it so that it can be ejected to the side as the bolt moves rearwardly after firing.

44. A weapon as in claim 43 including a spring biased ejection plunger in the recess, the plunger adapted to push against a spent cartridge casing and, in concert with the extractor to pivot it to one side for ejection from the receiver housing.

45. A weapon as in claim 38 wherein the lower bolt portion has a cam groove in its lower face, said feed advance means having a cam follower adapted to ride in the cam groove and to advance another cartridge for firing when the bolt assembly retracts to its fullest extent after firing.

46. A weapon as in claim 38 wherein the upper bolt portion includes skirt flanges and a buffer spring means thereon.

47. A weapon as in claim 1 including alignment means mounted on the bolt assembly to cooperate with the barrel assembly when the bolt is moving forward during chambering of a cartridge and to insure that:

i. the firing pin is correctly aligned with the cartridge primer, and ii. the extractor is engaged and the ejector is depressed by the cartridge head.

48. A weapon as in claim 47 wherein the upper bolt portion has a central portion and a flange portion, the flange portion including skirt flanges.

49. A weapon as in claim 48 wherein the central portion has a bore therein, the bore being counterbored for a greater part of its length, a buffer rod slidably mounted in the bore, compression spring means surrounding the buffer rod and extending rearwardly from the upper bolt portion a substantial distance, stop means on the rear end of the buffer rod to prevent disengagement of the spring means.

50. A weapon as in claim 49 wherein the alignment means is adapted to center the bolt assembly with the chamber means during the last one-half inch of forward travel of the bolt assembly.

51. A weapon as in claim 49 wherein the alignment means comprises a large member having an arcuate surface thereon whose radius center, when seated on the barrel assembly, is the exact center of the chamber means.

52. A weapon as in claim 51 including a resilient pad means on the rear of alignment means to soften the impact of the alignment means on the central portion of the upper bolt portion when the bolt means commences its forward travel during automatic firing after the buffer spring, hitting the buffer plate and compressing has moved the alignment means forwardly relative to the central portion.

53. A weapon as in claim 48 including hook means mounted between the skirt flanges in the flange portion, the hook means adapted to be set in one of two positions so as to alter the rate of fire of the weapon.

54. A weapon as in claim 53 wherein the alignment means has a pin means therein which is adapted to be engaged by the hook means in one position and not when the hook means is in the other position.

55. A weapon as in claim 54 wherein the flange portion has a recessed area therein, the hook means mounted in the recessed area and including a notch portion and a cam portion, the cam portion adapted to be engaged by the alignment means and to cam the notch portion away from the path of travel of the alignment means, the notch portion adapted to engage the pin means when the alignment means is thrust forward relative to the central portion of the bolt assembly when impacting the buffer plate.

56. A weapon as in claim 55 wherein the recessed area also includes a pivot means biasly mounting the hook means for pivotal movement and a latch means for changing the position of the hook means whereby in one position the hook means will be pivoted so as to not engage the alignment means resulting in one rate of fire and in the other position it will engage the alignment means and effect the rate of fire by altering the effect of the buffer assembly.

57. A weapon as in claim 56 wherein the bolt assembly includes a projection, the trigger means including a sear means normally adapted to engage the projection to prevent the bolt assembly from moving forward.

58. A weapon as in claim 57 wherein the trigger means comprises a unit member, an open ended slot in the unit member, two pivot pins in the slot, a trigger member pivotally mounted on one of the pins, the sear means pivotally and slidably mounted inward of the trigger member on the second pin, the sear means normally extending above the slot means and adapted to depress when the trigger is pulled thereby releasing the bolt assembly.

59. A weapon as in claim 58 wherein the sear means includes a sear member and a spring in the base of the slot normally biasing the sear member upwardly, the sear member having a smooth notch in one end, the trigger member having a projection thereon engaging in the notch.

60. A weapon as in claim 57 including a sear recoil pad between the sear means and the end of the slot to absorb the impact of the sear means engaging the sear projection.

61. A weapon as in claim 57 including a safety means associated with the receiver housing and the trigger means to prevent movement of the trigger means and consequent firing.

62. A weapon as in claim 1 wherein the chamber means includes enhancing means which initially hinders extraction of a fired cartridge from the chamber means and momentarily thereafter facilitates extraction of the cartridge from the chamber means by means of a momentary gripping action during the initial stage of the pressure buildup occasioned by firing the cartridge and thereafter utilizing the continued pressure buildup to facilitate extraction of the fired cartridge.

63. A weapon as in claim 62 wherein the chamber means comprises a cylindrical chamber portion, a shoulder portion and a bullet discharge portion, the enhancing means comprising a plurality of longitudinal slots in the chamber portion, the slots extending from the shoulder portion to a point short of the entrance to the chamber portion which is the end of the barrel.

64. A weapon as in claim 63 wherein the length of the slots is approximately two thirds of the chamber portion.

65. A weapon as in claim 63 wherein the slots are of identical configuration and are parallel.

66. A weapon as in claim 63 wherein there are approximately twenty slots around the circumference of the chamber portion and their length is about two thirds of the length of the chamber portion.

67. A weapon as in claim 63 wherein the chamber means is configured to fire 5.56 mm. cartridges.

68. A weapon as in claim 63 wherein the chamber means is configured to fire 7.62 mm. cartridges.

69. A weapon as in claim 63 wherein the chamber means is configured to fire 20 mm. shells.

70. A weapon as in claim 63 wherein the chamber means is configured to fire 40 mm. shells.

71. A weapon as in claim 63 wherein the chamber means is configured to fire 0.225 caliber cartridges.

72. A weapon as in claim 63 wherein the chamber means is configured to fire 0.30 caliber cartridges.

73. A weapon as in claim 63 wherein the chamber means is configured to fire 0.45 caliber cartridges.

74. A weapon as in claim 63 wherein the chamber means is configured to fire 0.50 caliber cartridges.

75. A weapon as in claim 63 wherein the chamber is configured to fire 0.22 caliber cartridges.

76. A weapon as in claim 63 wherein the chamber is configured to fire 9 mm. cartridges.

77. A weapon as in claim 1 including manually operable charging means for charging the weapon.

78. A weapon as in claim 77 wherein the receiver housing has a elongated slot therein, the charging means positioned in the slot and adapted to be pulled rearwardly to charge the weapon.

79. A weapon as in claim 78 wherein the charging means includes a front sight member thereon, the receiver housing having a rear sight member thereon.

80. A weapon as in claim 78 wherein the front of the receiver housing has a lug thereon, the charging means comprising a charging member slidably mounted in the slot, a latch means adapted to engage the lug to prevent rearward movement of the charging member and a handle connected to the latch means so that when a user pulls rearwardly to charge the weapon, the latch means disengages from the lug.

81. A weapon as in claim 80 including a sling swivel member connected to said charging member.

82. A weapon as in claim 80 wherein a portion of the latch means comprises a front aiming sight for the weapon.

* * * * *